United States Patent [19]

Ellicott

[11] Patent Number: 4,911,123

[45] Date of Patent: Mar. 27, 1990

[54] ELECTRONIC CONTROLLER FOR COMPRESSION ACTUATED FUEL INJECTION SYSTEM

[76] Inventor: George D. Elliott, 14902 Clovercrest Dr., Huntsville, Ala. 35803

[21] Appl. No.: 104,847

[22] Filed: Oct. 5, 1987

Related U.S. Application Data

[63] Continuation-in-part of Ser. No. 904,378, Sep. 8, 1986, Pat. No. 4,700,678.

[51] Int. Cl.[4] ..... F02D 41/34; F02M 49/02

[52] U.S. Cl. ..... 123/297; 123/476; 123/487; 239/87

[58] Field of Search ..... 123/297, 472, 478, 487, 123/476; 239/87

[56] References Cited

U.S. PATENT DOCUMENTS

| | | | |
|---|---|---|---|
| 3,081,758 | 3/1963 | May | 123/297 X |
| 3,665,902 | 5/1972 | Bloomfield | 123/297 |
| 3,892,207 | 7/1975 | Weise et al. | 123/305 |
| 3,980,061 | 9/1976 | McAlister | 123/297 |
| 4,040,395 | 8/1977 | Demetrescu | 123/297 |
| 4,062,327 | 12/1977 | Knights | 123/297 X |
| 4,066,046 | 1/1978 | McAlister | 123/297 |
| 4,247,044 | 1/1981 | Smith | 239/87 |
| 4,306,680 | 12/1981 | Smith | 239/87 |
| 4,359,032 | 11/1982 | Ohie | 123/458 |
| 4,389,997 | 6/1983 | Nakano | 123/492 |
| 4,393,845 | 7/1983 | Seitz | 123/478 |
| 4,394,856 | 7/1983 | Smith et al. | 239/87 X |
| 4,413,508 | 11/1983 | Kawamura | 73/116 |
| 4,434,770 | 3/1984 | Nishimura | 123/494 |
| 4,562,817 | 1/1986 | Ito | 123/478 |

*Primary Examiner*—Tony M. Argenbright

*Attorney, Agent, or Firm*—George J. Porter

[57] ABSTRACT

In an unthrottled fuel injection type internal combustion engine, a controlled injection logic to generate a first pulse train whose frequency varies with the accelerator position, N cylinder chambers (CCH's) 11, FIG. 1 ), each with a piston, and a distributor (111, FIG. 4) comprising N first devices and a rotor 109 for generating a second pulse each rotation past a first device, N fuel injection/ignition devices (FIGS. 1–2) each having a fuel ignition element (FIE) extending into a CCH to ignite the injected fuel and a fuel injector for injecting fuel towards each FIE at certain time intervals after the rotor passes the associated first device, a first counter for measuring, in time/degree of engine crankshaft rotation (ECR), the time required for M° of ECR, and for determining the rotor angular velocity. Second logic compares the rotor and accelerator pulses counted during a current time interval with the rotor and accelerator pulses counted in the prior time interval to determine if an advance T or a retardation of fuel injection is required and to calculate T in terms of the number of pulses of a given pulse train occurring after a calculated time interval Y after the second pulse caused by the rotor passing the associated first device, and third logic to compute fuel injection time $T_x$ in response to the throttle position, and fourth logic responsive to the end of each time period for implementing the newly computed fuel injection parameters.

23 Claims, 11 Drawing Sheets

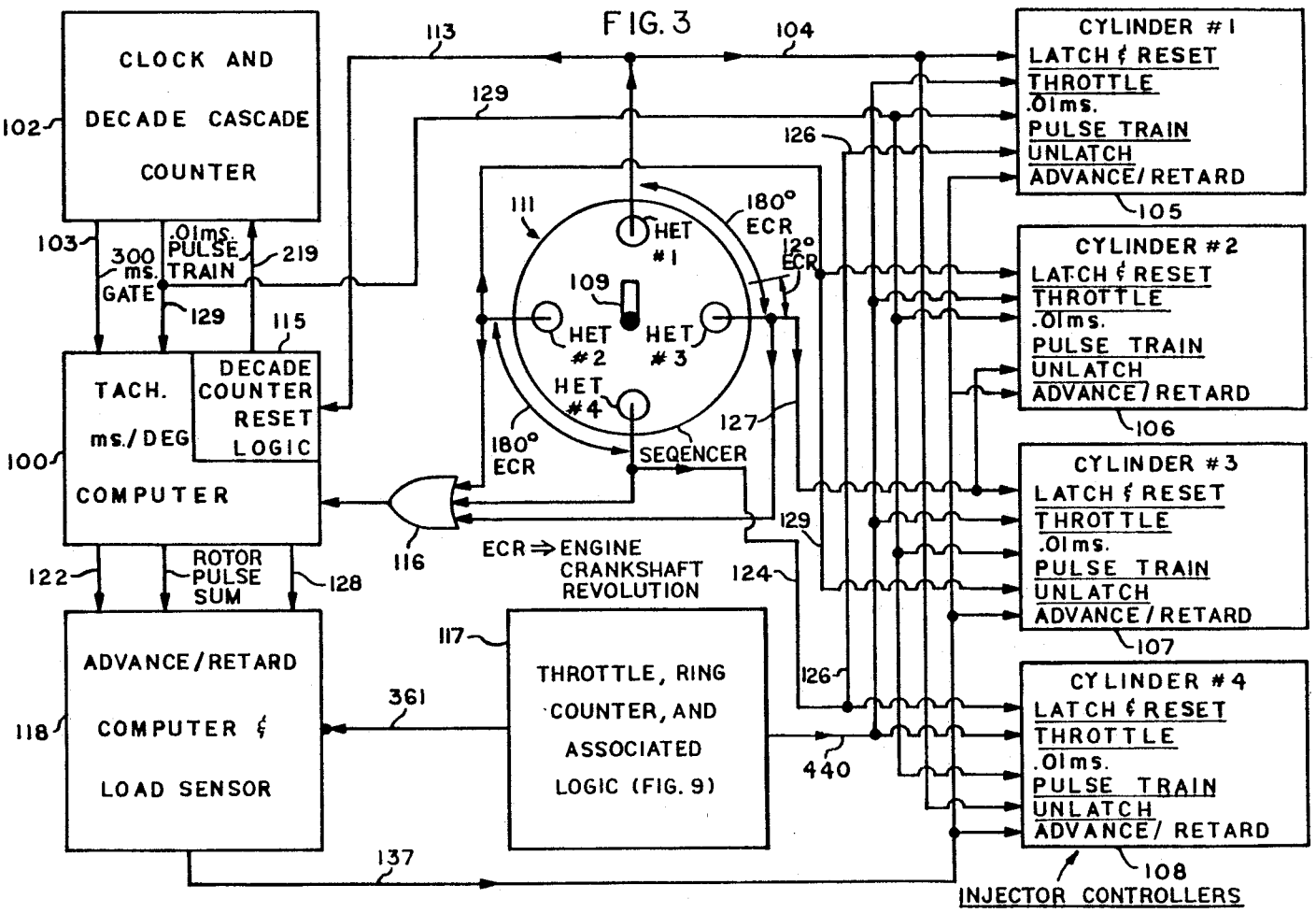
CYLINDER #1
LATCH & RESET
THROTTLE
.01ms.
PULSE TRAIN
UNLATCH
ADVANCE/RETARD
105
CYLINDER #2
LATCH & RESET
THROTTLE
.01ms.
PULSE TRAIN
UNLATCH
ADVANCE/RETARD
106
CYLINDER #3
LATCH & RESET
THROTTLE
.01ms.
PULSE TRAIN
UNLATCH
ADVANCE/RETARD
107
CYLINDER #4
LATCH & RESET
THROTTLE
.01ms.
PULSE TRAIN
UNLATCH
ADVANCE/RETARD
108
INJECTOR CONTROLLERS
FIG. 3
104
126
180° ECR
120° ECR
HET #1
HET #3
HET #2
HET #4
109
111
127
SEQENCER
129
124
ECR ⇒ ENGINE CRANKSHAFT REVOLUTION
THROTTLE, RING COUNTER, AND ASSOCIATED LOGIC (FIG. 9)
440
117
116
361
137
113
CLOCK AND DECADE CASCADE COUNTER
102
.01ms. PULSE TRAIN
219
300 ms. GATE
103
115
DECADE COUNTER RESET LOGIC
TACH. ms./DEG COMPUTER
100
128
ROTOR PULSE SUM
122
ADVANCE/RETARD COMPUTER & LOAD SENSOR
118

DECADE CASCADE COUNTER

NOTE: INITIATION OF SEQUENCING BEGINS WITH LATCHING AND CONTROLLER COUNT DOWN FOR INJECTION ~180° LATER

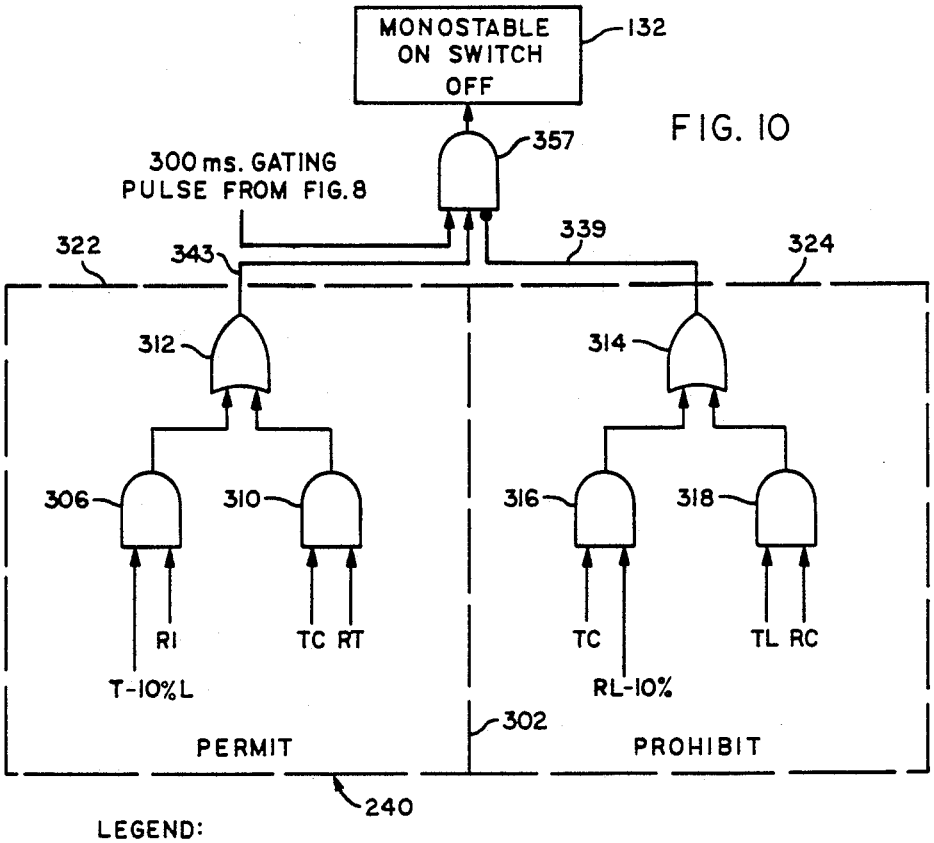
FIG. 10
LEGEND:
| THROTTLE PULSE COUNT | SEQUENCER (ROTOR) PULSE COUNT |
|---|---|
| LOWER ⇒ TL | LOWER ⇒ RL-10% |
| CONSTANT ⇒ TC | CONSTANT ⇒ RC |
| INCREASE ⇒ TI | INCREASE ⇒ RI |
FIG. 10a
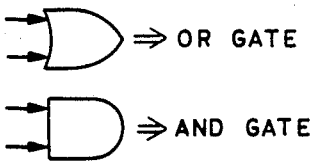
380
TRUTH TABLE
| THROTTLE | ROTOR | DECISION |
|---|---|---|
| TC | RI | PERMIT |
| TL | RL-10% | PERMIT |
| TC | RL-10% | PROHIBIT |
| TL | RC | PROHIBIT |

ELECTRONIC CONTROLLER FOR COMPRESSION ACTUATED FUEL INJECTION SYSTEM

CROSS-REFERENCE TO RELATED APPLICATION

This application is a continuation-in-part of prior U.S. patent application Ser. No. 06/904,378 filed September 8, 1986, now U.S. Pat. No. 4,700,678, issued October 20, 1987.

TECHNICAL FIELD

This invention relates generally to electronic ignition systems for fuel injection type engines and more particularly to an improved and simplified electronic ignition system that can be utilized with a variety of liquid fuels in various types of engines employing fuel injection and further using either arc producing devices (such as spark plugs) or any heat source capable of igniting the injected fuel, i.e. any fuel ignition device.

Because of the complexity of the present specification, it has been divided into sections identified by an index outline in the manner set forth below.

I. GENERAL BACKGROUND OF THE INVENTION
II. BRIEF SUMMARY OF THE INVENTION
III. BRIEF DESCRIPTION OF THE DRAWINGS
IV. BRIEF DESCRIPTION OF PRIOR ART—FIGS. 1 AND 2
V. OVERALL DESCRIPTION OF INVENTION—FIG. 3
VI. A GENERAL BUT SOMEWHAT MORE DETAILED DESCRIPTION OF THE INVENTION—FIGS. 4, 5, AND 6
A. DETAILED DESCRIPTION OF FIG. 4
B. DETAILED DESCRIPTION OF FIG. 5
C. DETAILED DESCRIPTION OF FIG. 6
VII. DETAILED DESCRIPTION OF INVENTION—FIGS. 7, 8, AND 9
A. DETAILED DESCRIPTION OF FIG. 7
B. DETAILED DESCRIPTION OF FIG. 8
C. DETAILED DESCRIPTION OF FIG. 9
VIII. ALTERNATIVE FORM OF THE INVENTION
IX. DISCUSSION OF FIG. 10

I. GENERAL BACKGROUND OF THE INVENTION

Generally, fuel injection systems, both for diesel engines employing glow plugs and gasoline engines employing spark plugs, are well known in the art. However, no, prior art devices are known which combine a variably controlled injection of fuel directly past the fuel ignition element, sometimes referred to herein as an FIE, initiation (advance or retard) and duration of fuel injection is electronically computed and controlled in order to determine the output power of the engine.

The known prior art fuel injection systems are substantially stoichiometric in nature in that the fuel is injected in response to a controlled volume of inducted air. Rather, the fuel is injected in a manner to first fill the firing chamber in a substantially uniform mixture of fuel and air, thus allowing subsequent burning of the fuel to be comparatively uncontrolled in that such burning can occur progressively along various different paths within the firing chamber. Thus, these prior art fuel injection systems do not effectively control the burning rate of the fuel but rather permit burning to be initiated by an adiabatic temperature rise which spreads unevenly throughout the firing chamber, thus producing inefficient burning of the fuel and often causing a phenomena commonly known as "knocking" or "pinging" which is presently controlled by fuel additives, many of which have been shown to be environmentally hazardous.

The aforementioned method of mixing fuel and air substantially uniformly in the firing chamber and in the approximately correct proportion so that all of the fuel and all of the oxygen in the firing chamber combine during burning is known, as mentioned above, at least, an approximate stoichiometric mixture. In other words, each molecule of gasoline theoretically will combine with a sufficient number of oxygen molecules so that a minimum of fuel or oxygen remains after burning of the fuel is completed. As indicated above, this stoichiometric mixture of fuel and air is not only extremely difficult to obtain but also does not produce the controlled burning of the fuel required to provide the greatest and most efficient production of power with the least damage to the engine.

Reference is made to page 171 of a publication entitled "Foundations of College Chemistry," 2nd Edition, by Hein, published in 1970 by Dickinson Publishing Company of Belmont, California, which states that, "the student . . . should solve each problem by . . . being certain that equations are balanced and mathematical calculations are accurate . . . This section of chemistry, based on weight and mole relationships of chemical formulas and equations, is commonly called stoichiometry."

In prior art gasoline engines employing fuel injection, burning does not begin until the spark occurs, by which time the gasoline has become diffused through the firing chamber and is, in effect, an approximate stoichiometric mixture of gasoline and air (oxygen). The aforementioned will occur even if the advance timing and duration of the fuel injection is controlled electronically.

In prior art diesel engines using fuel injection, the fuel is first injected and then compressed to the point where it self-ignites. By the time the fuel ignites, however, it has become an approximate mixture, even with electronic computation of the fuel injection time duration and amount of advance.

It would make a definite advance in the art to provide an almost completely non-stoichiometric fuel injection system in which the fuel is injected, under the control of an electronically controlled timing system, towards a constantly heated ignition source and therefore is burned substantially uniformly from the beginning to the end of the fuel injection period without first diffusing generally with the air in the firing chamber. The time duration of the fuel injection and the degree of advance can be determined by the electronically controlled timing system of the present invention.

There exists in the prior art one type of fuel injector-/ignitor device (an IID), which combines a glow plug (GP) with a compression actuated fuel injector (CAFI), and which is quite compatible with the present invention. This IID is the subject of a pending U.S. patent application filed by George D. Elliott, the inventor of the present invention, Ser. No. 904,378, filed September 8, 1986, entitled "Fuel Injector", and incorporated in its entirety by reference herein.

II. BRIEF SUMMARY OF THE INVENTION

It is a primary object of the invention to provide such an almost completely non-stoichiometric fuel injection system in which the fuel is injected towards a constantly heated fuel ignition device or element (an FIE) through a CAFI so that burning of the fuel occurs substantially uniformly over the entire fuel injection period and within a relatively small portion of the firing chamber, thus insuring more efficient burning of the fuel with resulting greater uniformity of generated power per unit of fuel and with less damaging effects to the engine.

It is another primary object of the invention to control the advance and duration of the fuel injection period by a new and novel electronically timing control system which responds to various conditions of engine crankshaft (EC) angular velocity and accelerator or throttle position and movement to constantly update the advance and time duration of the fuel injection to accommodate the changing conditions of EC angular velocity and accelerator position and movement.

It is still another object of the invention to combine a constantly heated ignition source (an FIE) with a fuel injector (an FI) to form an injector/ignitor device (an IID), which injects fuel towards said FIE and which burns during the entire fuel injection period, and an electronic timing control system responsive to changing EC angular velocity and accelerator position to continuously update and control the advance and fuel injection period to their newly computed required values.

In accordance with one preferred embodiment of the invention there is provided, in a fuel injection type internal combustion engine comprising an accelerator, N cylinder chambers, a piston associated with each cylinder chamber, and a distributor comprising N first devices and a rotatable rotor positioned to generate a pulse each rotation past a first device, an electronic fuel ignition system comprising N fuel ignition elements (FIE's) each extending into one of the N cylinder chambers to maintain burning of the injected fuel, a fuel injector for injecting fuel towards each FIE at predetermined time intervals with respect to the time the rotor passes a first device, first logic for controlling the beginning and the duration of fuel injection into each cylinder chamber, a counter cascade for generating a series of frequency pulse trains, a first counter for measuring the time required for M degrees of engine crankshaft rotation (ECR), defined as (ms/M deg), with the time being measured by the number of first pulses of a pulse train derived from the counter cascade and for determining the substantially instantaneous angular velocity of the ECR per degree (ms/deg). Second logic counts and then compares the number of rotor and throttle pulses occurring during a current given time interval Z with predetermined changes in the number of rotor and throttle pulses counted during the immediately prior time interval Z to determine whether an advance T or a retarding of the beginning of fuel injection is required and also to calculate the amount of T in terms of a calculated number of the first pulses beginning immediately after a predetermined time interval Y measured from the pulse caused by the rotor passing the first device associated with the cylinder chamber receiving the fuel, and third logic for determining the fuel injection time $T_x$ responsive to a second pulse train generation by the depression of the accelerator, and whose frequency varies with the degree of accelerator depression, and for measuring the time $T_x$ which is determined by the frequency of the second pulse train, and fourth logic means responsive to the end of a time period Y for implementing each newly computed beginning of, and time duration of, the fuel injection.

It should be understood that this specification, claims and drawings are directed toward an unrestricted air intake and an unrestricted airflow into the engine. Throughout the specification, claims and drawings, the terms "throttle" and "accelerator" have been used interchangeably and refer to the control of the fuel injected into the engine. The controller covered by this application distinguishes over the known prior art devices in that this device combines two features:

1. Unrestricted airflow into the engine.
2. Control of the power output of the engine by using a throttle or accelerator to control both the amount and the time duration of the fuel injected into the engine. The fuel is burned as it is injected into the engine.

III. BRIEF DESCRIPTION OF THE DRAWINGS

The above-mentioned and other objects and features of the invention will be more fully understood from the following detailed description thereof when read in conjection with the drawings in which.

Figure 3A:
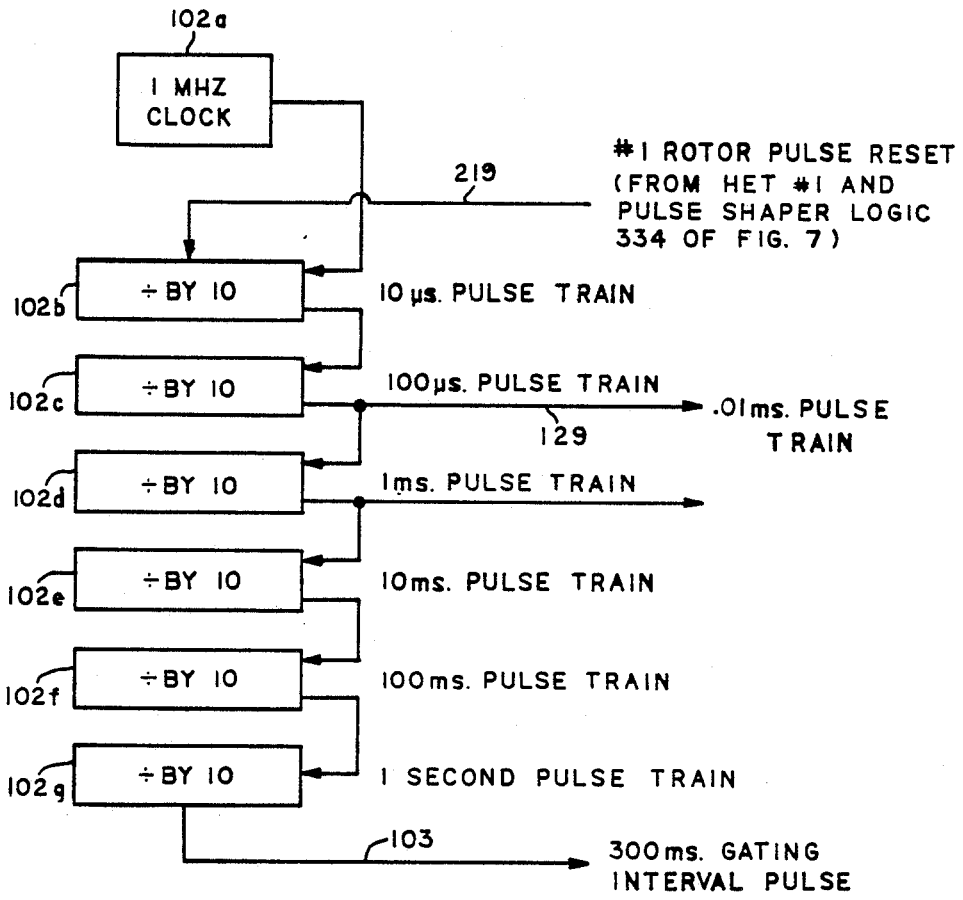
FIG. 3 shows a general, overall block diagram of the invention.
Figure 4:
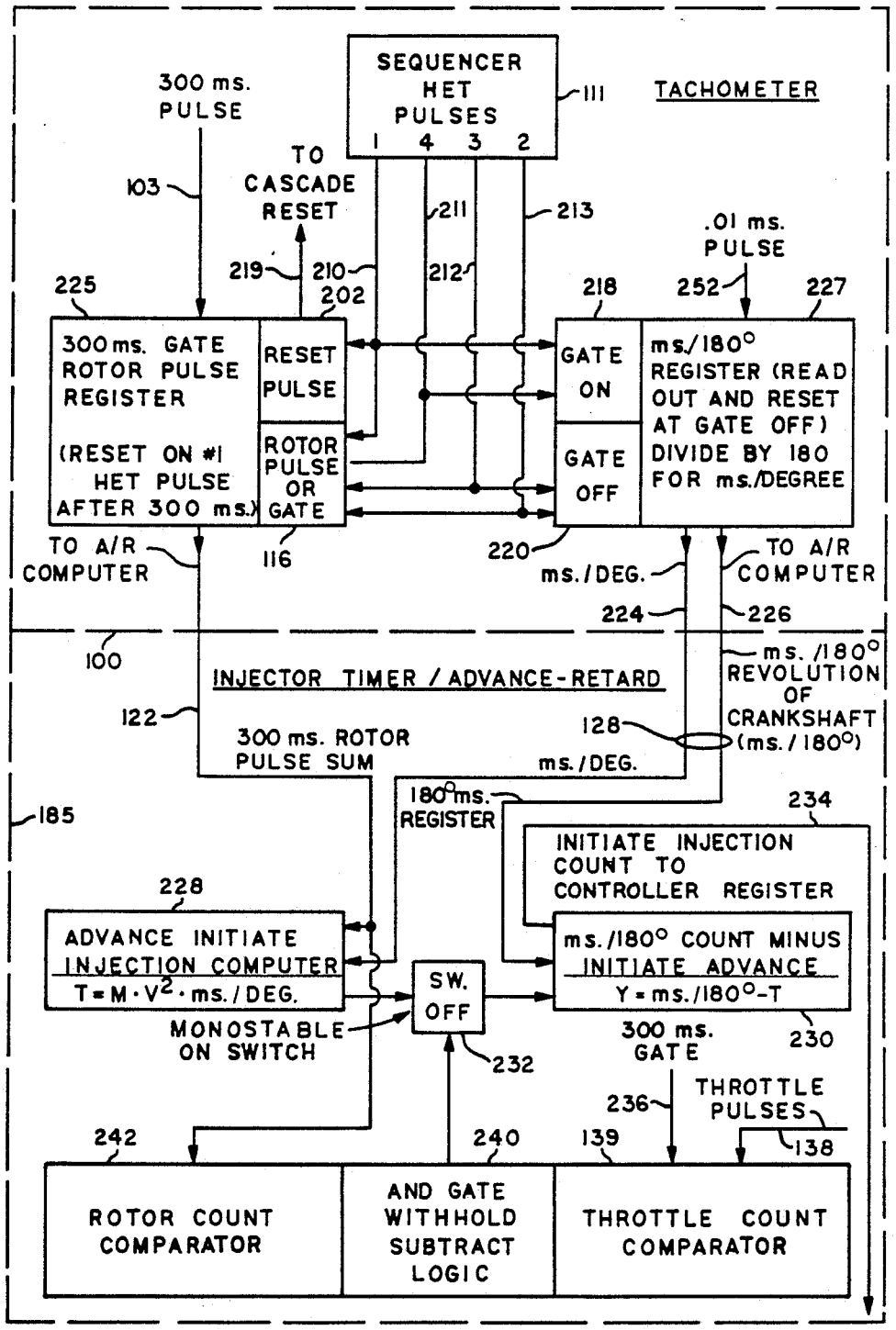
Figure 5:
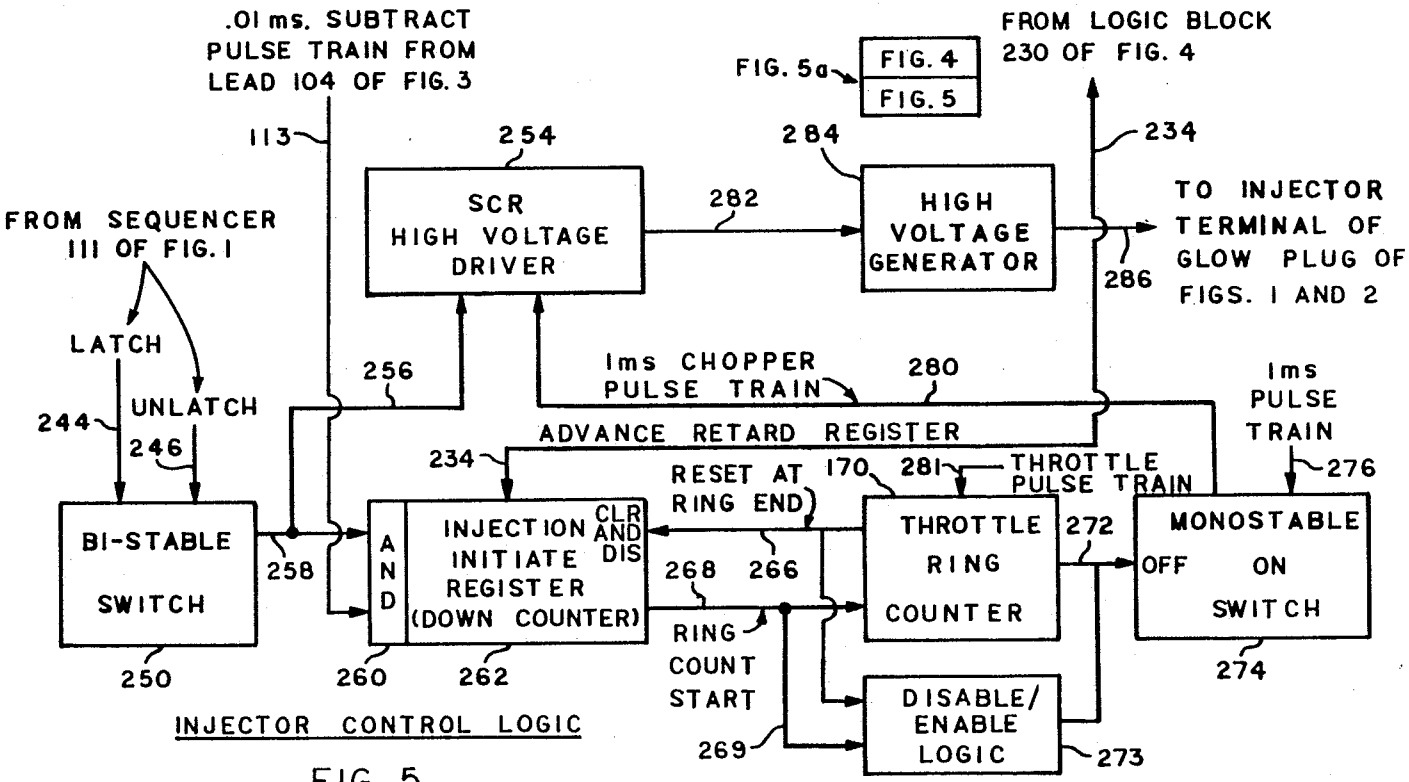
Figure 6:
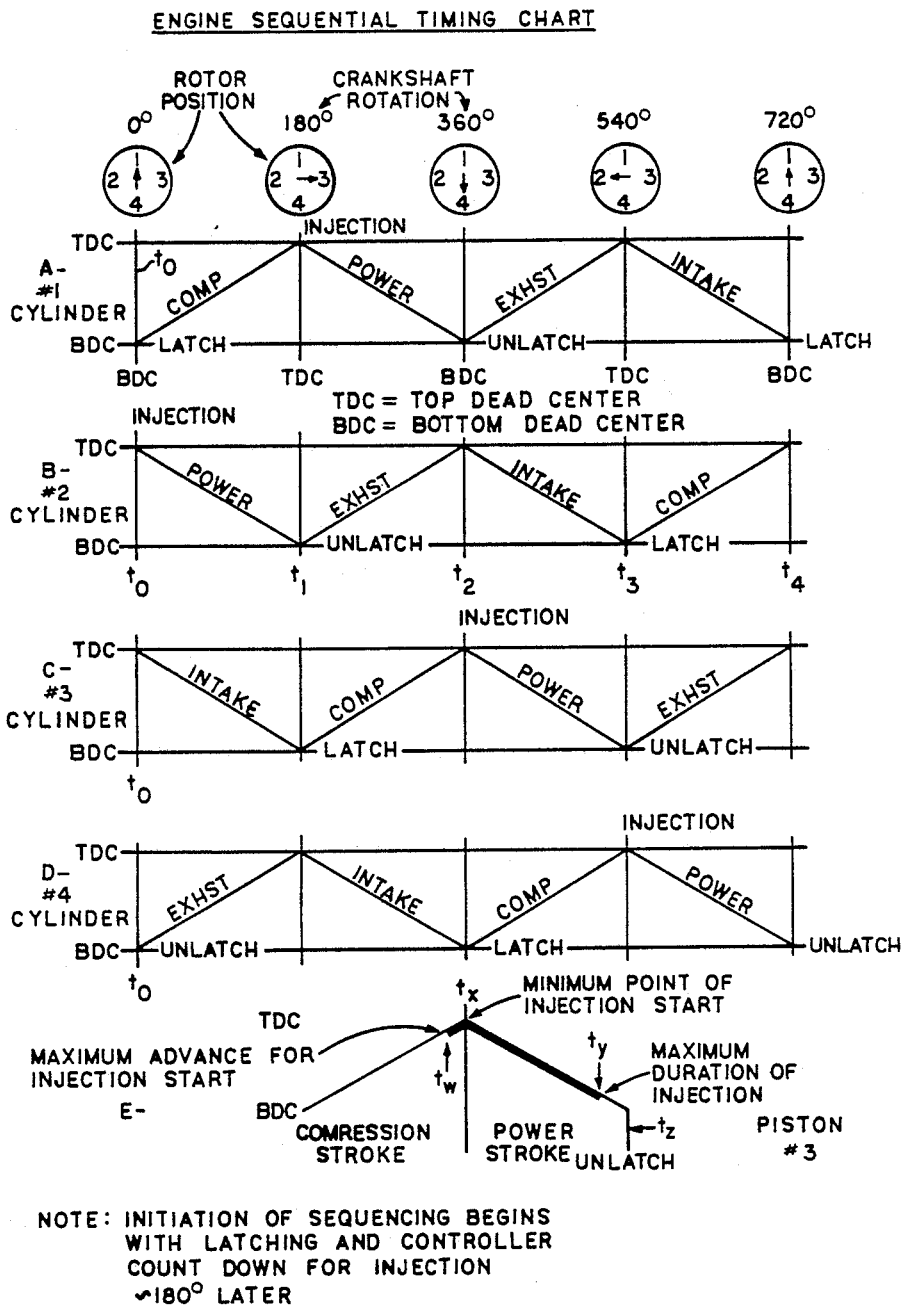
Figure 7:
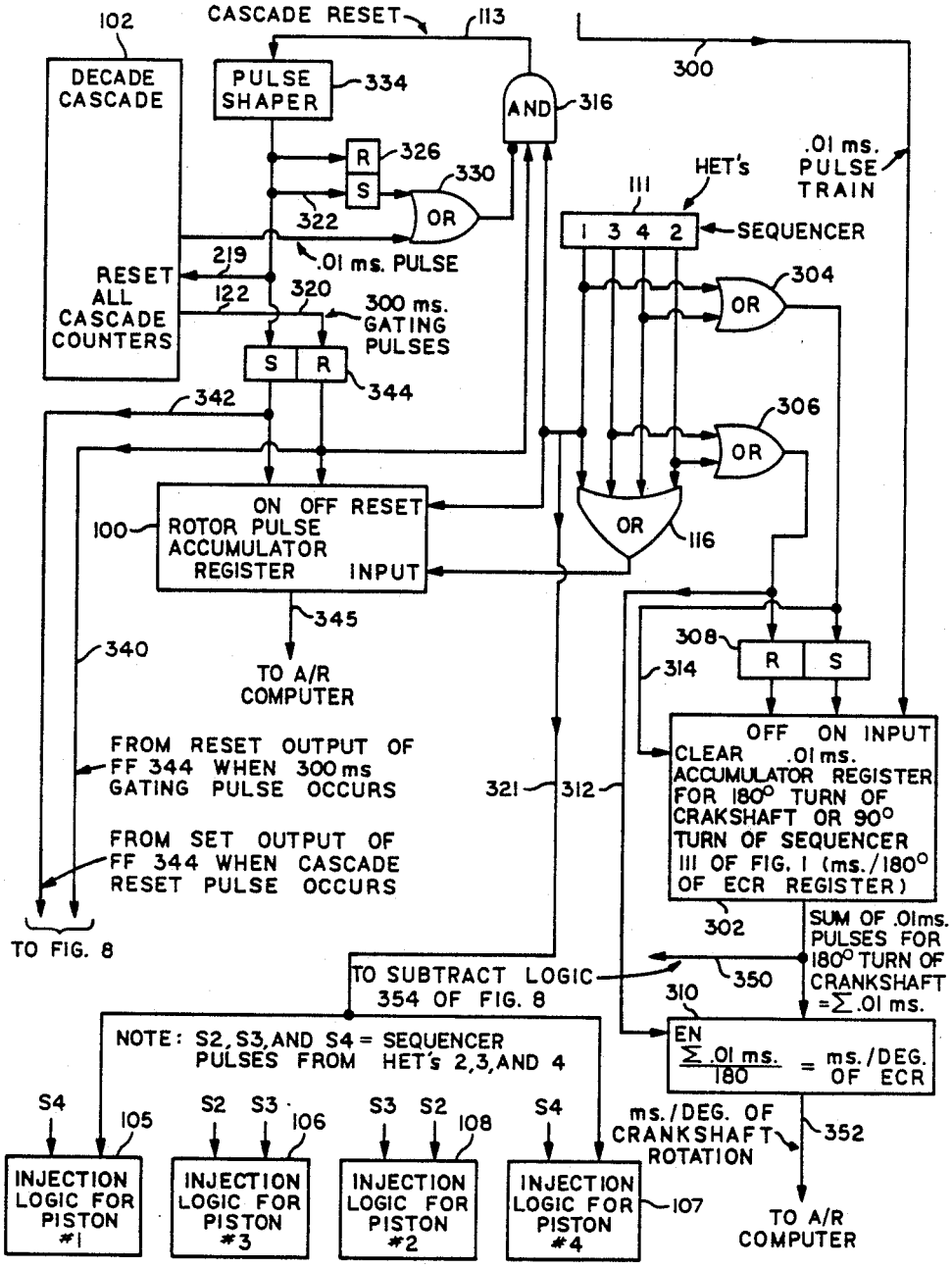
Figure 8:
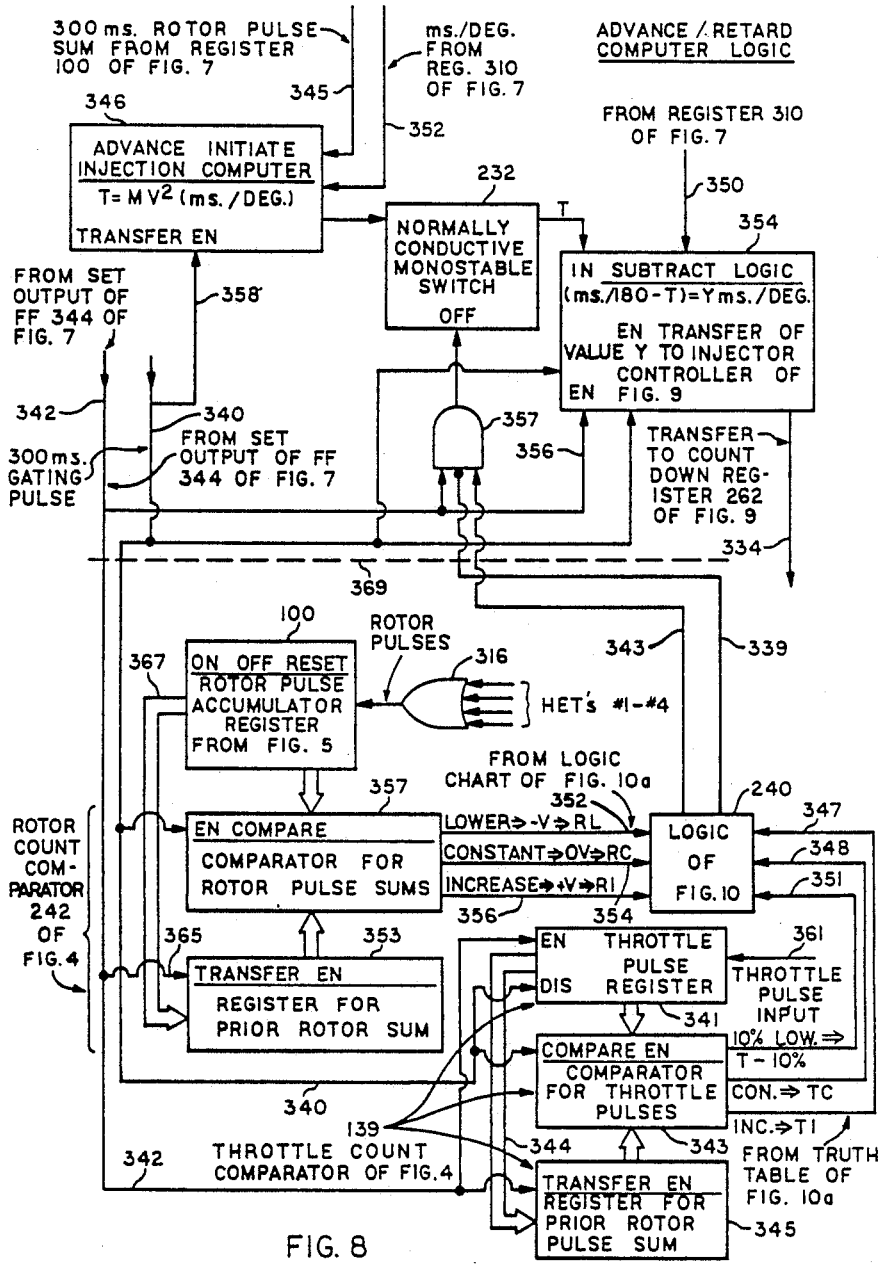
Figure 9:
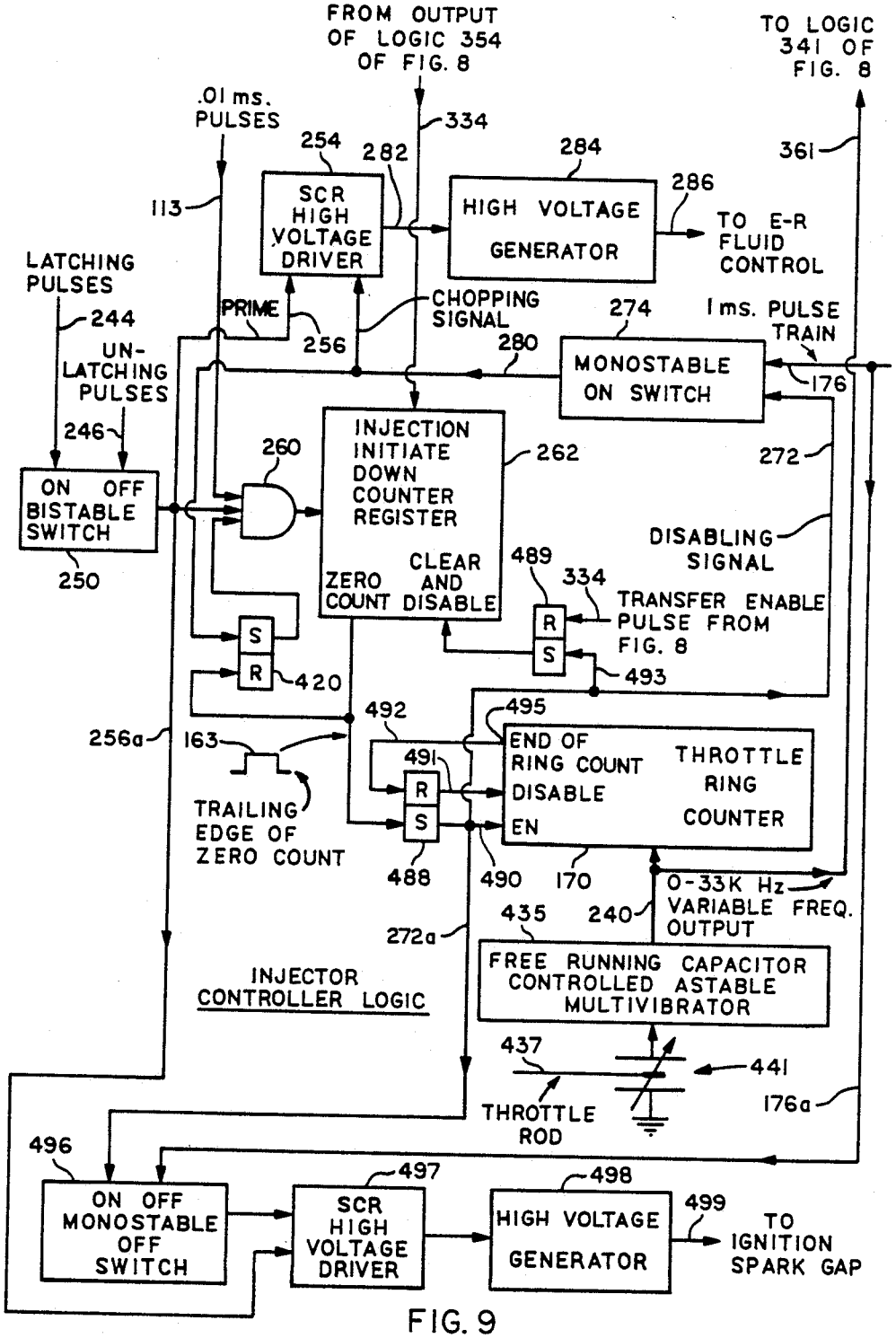
Figure 7A:
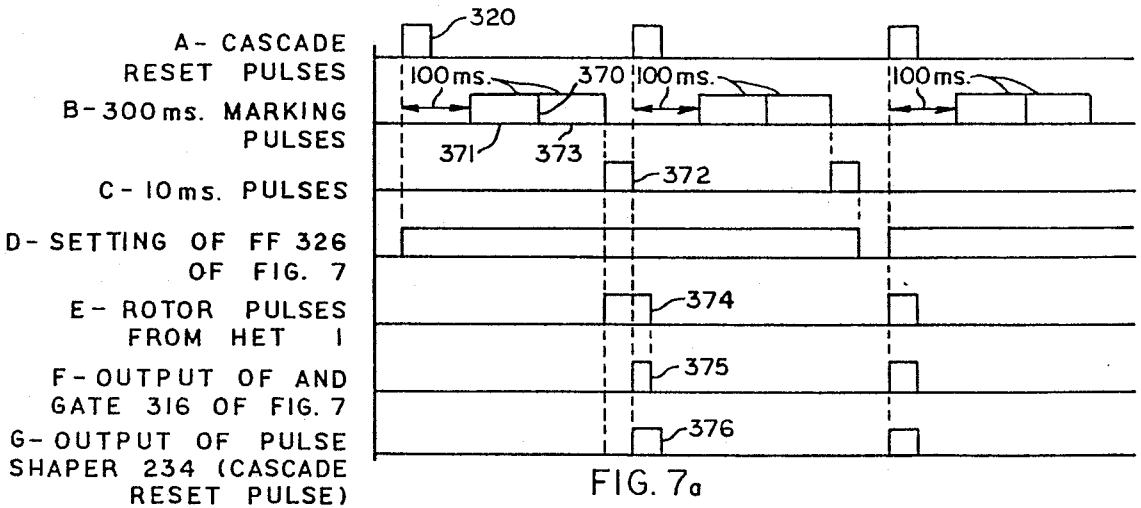
Figure 9A:
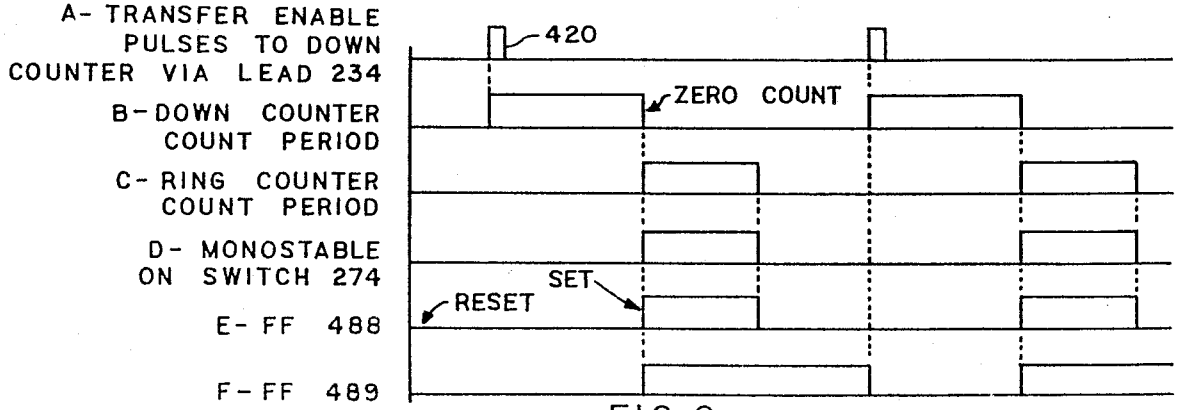

FIG. 3*a* is a more detailed showing of the decade counter of FIG. 3;

FIGS. 4 and 5, considered together in the placement manner shown in FIG. 5*a*, show a somewhat more detailed overall diagram of the invention but with each major logic section showing the sub-logic sections contained therein;

FIG. 6 shows a timing diagram of the time relation of the movement of the pistons and the time of latching and unlatching of the IC associated with each piston;

FIG. 7 is a detailed logic diagram of the tachometer logic;

FIG. 7*a* is a timing diagram of the operation of the tachometer logic of FIG. 7;

FIG. 8 is a detailed logic diagram of the injector timer for the advance/retard logic;

FIG. 9 shows a detailed logic diagram of the injection controller of the invention;

FIG. 9*a* is a timing diagram of the injection controller;

FIG. 10 shows detailed logic of a portion 240 of FIG. 8 which interprets throttle and rotor pulse rates to output a signal determining whether the time of fuel ignition should be advanced or retarded; and FIG. 10*a* is a truth table relating to the logic 240 of FIG. 8.

IV. BRIEF DESCRIPTION OF PRIOR ART FIGS. 1 AND 2

Figure 1:
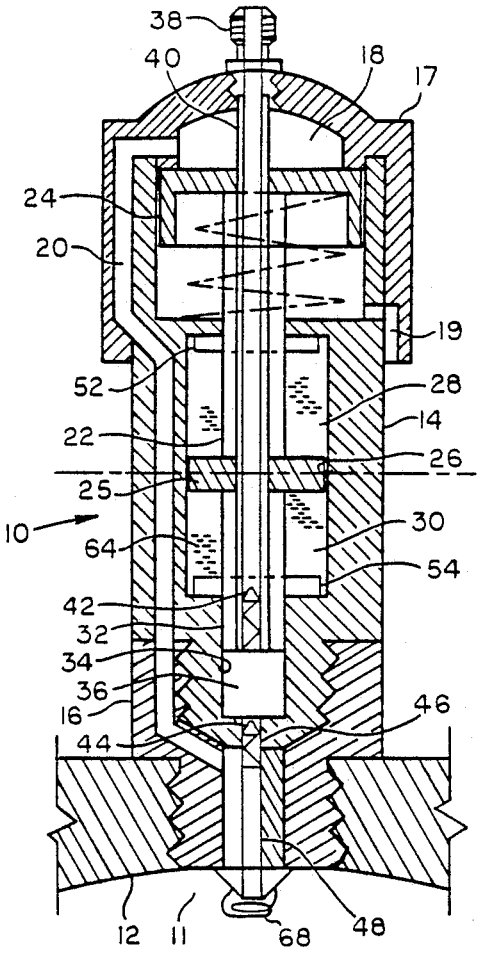
FIGS. 1 and 2 show a prior art IID of the CAFI type fuel injector device.
Figure 2:
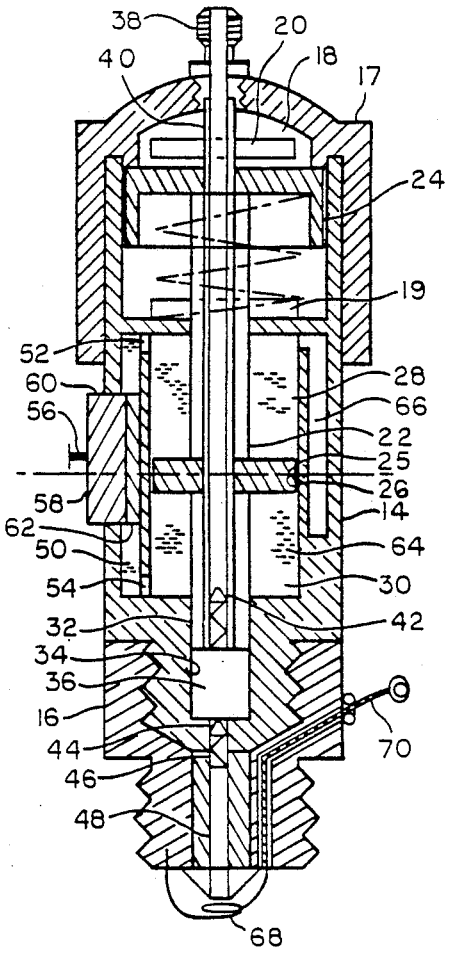

Referring first to FIGS. 1 and 2 there is shown a prior art injector/ignitor device (IID), referred to hereinbefore as the subject matter of U.S. patent application Ser. No. 904,378, which can be employed, if desired, in lieu of other suitable IID's, with the present invention to provide a complete electronically controlled fuel injection system. Referring now to FIG. 1 of this prior art injector 10 is adapted for threaded engagement into a cylinder head 12 of an internal combustion engine. The injector comprises a housing assembly which is made up of three basic housings, the details of which will be described hereinafter.

An injector housing 14 is threadedly attached to a nozzle housing 16 at its lower end. The nozzle housing in turn is threadedly attached to the cylinder head 12. At the upper end of injector housing 14 is attached a compression chamber housing 17 which, in combination with the injector housing 14, forms a compression chamber 18. Compression chamber 18 communicates with a combustion chamber 11 of cylinder head 12 through a compression passage 20 which is formed by the compression chamber housing 17, the injector housing 14, and the nozzle housing 16. An injector rod 22 is slidably mounted within injector housing 14. At the upper end of injector rod 22 is attached a primary piston 24 which is located within the compression chamber 18. The area below primary piston 24 is vented to the atmosphere by a passage 19. A metering spool 25 is rigidly attached to the mid portion of the injector rod 22 and is slidably mounted in a metering chamber 26 which is formed in the intermediate portion of the injector housing 14. The metering spool 25 effectively separates the metering chamber 26 into an upper chamber 28 and a lower chamber 30. At the lower end of injector rod 22 is formed a secondary piston 32 which slidably engages a cylinder wall 34 which forms a fuel supply chamber 36 within the lower portion of the injector housing 14. At the upper portion of the injector a fuel inlet fitting 38 is threadedly attached to the combustion chamber housing 17 and is also rigidly attached to a fuel supply tube 40 which passes through and slidably engages the center portion of injector rod 22. A spring biased check valve 42 is mounted within the lower portion of the fuel supply tube 40 to prevent reverse flow of fluid in the supply tube. An additional check valve 44 is provided in a lower passage 46 which communicates with a passage 48 formed in the nozzle housing. Passage 48 thus communicates with compression passage 20 as well as with the fuel supply passage 46. The valve 44 serves to prevent combustion pressures from entering fuel supply chamber 36 but allows pressurized fuel to pass en route to the combustion chamber 11.

Alternatively the fuel may also be fed directly into the fuel supply chamber 36 through a fuel supply passage 47 formed in the lower side portion of injector housing 14.

Referring now to FIG. 2, it will be noted that a fluid bypass chamber 50 is formed in the side portion of injector housing 14 and provides communication via outlets 52 and 54 between the upper portion 28 and the lower portion 30 of metering chamber 26. An electrical connection 56 is mounted to an insulated housing 58. The connector 56 is conductively connected to a series of electrodes 60 which are illustrated in FIG. 2. As will also be noted in FIG. 2, a series of electrodes 62 are conductively mounted to the inner portion of injector housing 14 and are located within the bypass chamber 50. Thus it will be seen that upon application of a voltage to electrical connector 56, an electrical potential will exist between the positive electrodes 60 and the negative electrodes 62, which are grounded through the cylinder head 12 to the electrical system of the vehicle. An electro-rheological (E-R) fluid 64 completely fills the metering chamber 26 and the bypass chamber 50. An expansion chamber 66 shown in FIG. 2 is provided in communication with the metering chamber to provide for expansion resulting from a rise in temperature of the fluid. A wire 68 which is heated by an electrical current supplied through an insulated feed line 70 serves to ignite the fuel which is injected into the combustion chamber 11.

In operation of the device, during an engine's compression stroke, the compression from within cylinder head 12 will be transmitted to compression chamber 18 via compression passage 20. Thus the compression pressure will attempt to force the primary piston 24 and the entire ejector rod 22 to a downward position. Unless restrained the secondary piston 32 of injector rod 22 will move into the fuel supply chamber 36 and force the entire fuel supply from supply chamber 36 into the combustion chamber of the cylinder head 12. A timed restraint and release of the injector rod 22 is necessary to permit precisely measured downward movement of the secondary piston 32 into the fuel supply chamber 36 so as to meter the amount of fuel and the timing of its injection into the combustion chamber 11 in accordance with the needs of the engine.

The restraint and release of the injector rod 22 is accomplished by the application and removal of an electrical potential between electrodes 60 and 62. When applied this potential will substantially solidify the electro-rheological fluid between the electrodes 60 and 62. Thus as best seen in FIG. 2 the injector rod 22 can move only when the electro-rheological fluid is in its fluid state which permits flow between chambers 28 and 30 as the metering spool forces the fluid through bypass chamber 50 via the outlets 52 and 54. Substantial solidification of the electro-rheological fluid 28 between the electrodes when the electric potential is applied will instantly block the fluid flow between chambers 28 and 30, thus preventing further movement of the spool 25 and its associated injector rod elements, and thereby limit the amount of fuel forced from fuel supply chamber 36 into combustion chamber 11.

In a partial throttle situation a typical computer controlled system which would be responsive to all criteria necessary for determining fuel flow such as throttle position and timing advance will be connected to the electrical connector 56 so as to provide appropriately timed signals thereto. The air fuel mixture is then ignited by the heated wire 64 or any suitable ignition device.

For a more detailed description of the prior art device of FIGS. 1 and 2 and of the electro-rheological fluid, reference is made to the above-identified co-pending application, Ser. No. 904,378. The E-R fluid is manufactured by the Lord Corporation of 407 Gregson Drive, MacGregor Park, Cary, North Carolina 27511.

V. OVERALL DESCRIPTION OF THE INVENTION—FIG. 3

It is to be noted that in the example of the present specification describes an ignition system for a four cylinder engine, including the expressions ($T=MV^2$ (ms/deg)) and ($Y=ms/180°-T$) in logic blocks 228 and 230 of FIG. 4. For vehicles having other than four cylinders, such as 6 or 8 cylinders the general expression in logic block 230 is $$Y=ms/720/N-T=N\ ms/720-T$$

where T=the advance in ms/deg, N is the number of cylinders, and the values T and 720/N are both measured in the number of 0.01 ms pulse required for the engine shaft to rotate 720/N at the current angular velocity of the engine shaft and for the advance T. For a four cylinder engine N=4 and 720/N=180°. It is also apparent the number of distributor devices, such as the Hall effect transistors of FIG. 3, will also change to equal the number of cylinders.

As indicated above the invention is described in terms of a four cylinder engine utilizing CAFI'S (with G.P's) of the type shown in FIGS. 1 and 2 and with the fuel being injected in the cylinder chamber directly through the CAFI and at the glow plug wire. In other forms of the invention the FIE and the fuel injection (FI) means can be separate structures. For example, the FIE, which can be a spark plug or a glow plug, for example, with the fuel injection structure being a different and separate structure and located at a different position in the cylinder chamber but with the fuel being injected towards the FIE to maintain an almost non-stoichiometric mixture of fuel and air. It is to be specifically noted that IID'S employing spark gaps or any FIE can be used in lieu of a glow plug type IID.

Other changes are required to adapt the invention to engines having a number of cylinders other than four. For example, the number of injector controllers (IC'S), to be discussed in detail later herein, must be changed to equal the number of cylinders.

Certain abreviations are sometimes also used herein as follows:

ECR=>engine crankshaft revolution (or rotation)
EC=>engine crankshaft
PPD=>pulse producing device (such as an HET).
HET=>Hall Effect transistor
IC=>Injector Controller
FI=>fuel injector
FIE=>fuel ignition element; ignites the fuel by an ignition source such as an arc or a heated wire or other element
FID=>a fuel injector device
GP=>glow plug; ignites the fuel by a constantly glowing (caused by heating) element
Z=>the parameter updating time; a time interval of 300 ms is used in the 4 cylinder example of the specification
M=>the number of degrees of ECR employed to determine the value (ms/Mdeg); M=180° of ECR in the example of the specification.
IID=>an injector/ignitor device; includes both a fuel injector (FI) and a fuel ignition element (FIE)
CAFI=>compression actuated fuel injector
Mc=>a constant in the expression $T=McV^2$(ms/deg)
Tx=>the time interval of fuel injection
AIIC=>advance initiate injection computer Referring now to FIG. 3 a decade cascade counter 102 provides the timing for the entire system and consists of a basic 1 MHz clock 102 which divides 1 us pulses into pulse trains sequentially divided by factor of 10 into pulse trains of such as 10 us, 100 us, 1 ms, 10 ms, 100 ms, and 1 second pulse trains, as shown in the more detailed diagram of the decade cascade counter 102 of FIG. 3*a*. Such decade cascade counter is sometimes referred to herein as a decade counter or simply as a counter cascade. Counters based on counting cycles other then ten can also be employed in the invention. In FIG. 3*a* the decade cascade counter 102 of FIG. 3 includes a separate section for each stepped-down train of pulses identified by reference characters 102*b*–102*g*, with the master 1 MH clock being identified by reference character 102*a*.

In the specific embodiment of the invention described herein only the outputs from the pulse trains of counter sections 102*c*, 102*d*, and 102*g*, are used and supply, respectively, trains of pulse spaced apart 0.01 ms, 1 ms, and with the 300 ms gating pulse from section 102*g* marking a 300 ms period after the resetting of the entire decade cascade counter to zero by a rotor pulse from HET #1 of FIG. 3. In FIG. 3 each of the sections count to ten and then register one count in the next subsequent section.

Decade counter 102 supplies a pulse train of 0.01 ms pulses to tachometer logic 100 via lead 103. The tachometer logic 100 functions primarily to compute the milliseconds (in the number of 0.01 ms pulses) required for the engine crankshaft to rotate one degree (ms/deg) averaged over the period of the 300 ms gating time interval.

To accomplish the foregoing it is also necessary to know the average angular velocity of the engine crankshaft which rotates twice, or 720°, each time the rotor 109 of distributor 111 rotates once, or 360°. It is apparent that if the number of 0.01 ms pulses occurring during each 720 revolution, or each 180° of the engine crankshaft revolution (ECR) that the ms/deg of revolution of the crankshaft (measured by the number of 0.01 ms pulses) can be computed.

The detailed logic for accomplishing the above computation of ms/deg is shown in FIG. 7 and will be discussed in detail later herein. Assume for the present that such ms/deg computation is done in logic block 100 of FIG. 3.

A sequencer 111 consists of a rotating magnetized rotor 109 and four Hall effect transistors (HET's) HET #1, HET #3, HET #4, and HET #2, which the magnetized rotor 109 passes as it rotates in a clockwise direction in the sequence listed. It is a characteristic of an HET that when a magnetized rotor (or any magnet) passes thereby a pulse is generated in the HET. The pulses generated in the HET's #1, #3, #4, and #2 are supplied to IC's 105, 107, 108, and 106, respectively, via leads 104, 127, 126, and 129, respectively. These pulses are known as rotor pulses and play an important role in the current invention as will be seen as its details are disclosed in the following specification.

The rotor pulses occurring during each 300 ms time period are first accumulated in tachometer logic 100 and then transferred via lead 130 to the advance/retard logic 118 for computation of the amount of fuel injection advance or retard and the duration of fuel injection. Other inputs, such as throttle pulses accumulated during the 300 ms time interval, are also used in the computation of the decision to advance or retard, as will be discussed in detail later herein.

It will be noted in FIG. 3 that the decade counter 102 will be reset to zero via lead 113, decade counter reset logic 115 and lead 219 each time the rotor 109 passes HET #1 after the occurrence of the 300 ms gating pulse. The details of the logic producing the aforementioned timing sequence will be discussed in detail later herein in connection with the discussion of FIGS. 7 and 7*a*.

The foregoing resetting of decade counter 102 to zero is to ensure that the 300 ms gating time period always begins at the time the rotor 109 passes HET #1 and generates what is defined herein as the master timing pulse.

It will be noted later herein that the time of occurrence of the 300 ms gating pulse, marking the end of the 300 ms gating period, is of vital importance in that it initiates the comparison of both the rotor pulses and the throttle pulse (discussed generally in the following paragraphs) accumulated during the just completed 300 ms time interval with the rotor and throttle pulses accumulated in the immediately prior 300 ms time interval. As indicated above such comparison is done in the advance/retard computer 118 to determine the advance or retard of the beginning of the fuel injection.

The throttle pulses are generated and accumulated in logic 117 of FIG. 3 at a frequency determined by the degree of depression of the throttle accelerator (shown in FIG. 9). The greater the depression of the accelerator the less the frequency of the generated throttle pulses which are supplied to a ring counter 170 as discussed in connection with FIGS. 8 and 9 and whose complete count around the ring determines the fuel injection period, thus allowing a greater time period for fuel to be injected into the firing chamber and resulting in more force being generated on the piston during the longer burning period. A more detailed discussion of the relationship between the throttle pulses, the degree of depression, and their function will be discussed in connection with FIGS. 8 and 9.

It should be noted the time required for the throttle pulses to count around the ring counter logic 117 of FIG. 3 (which includes the ring counter 170 of FIG. 9) is for the purpose of determining the fuel injection time interval. The throttle pulses are also accumulated during the 300 ms time interval after the resetting of decade counter 102, and the accumulated total supplied via lead 361 to the advance/retard (A/R) computer 118 of FIG. 3 and to throttle inputs of the injector controllers (IC) 105–108 of FIG. 3 via lead 440.

Generally speaking, the relative changes in the number of rotor and throttle pulses occurring during consecutive 300 ms periods parameter updating time intervals determine whether the time of injection of the fuel will be advanced or retarded by means of the advance/retard computer logic 118 of FIG. 3 in accordance with the truth table of FIG. 10*a*.

As mentioned above, an important function of the throttle pulse frequency is that it also is the controlling factor in determining the time interval or period of injection $T_x$ of the fuel. More specifically throttle pulses are supplied to a ring counter contained in IC's 105–108 of FIG. 3 until the ring counter counts around to its starting point in response to the throttle pulses.

Fuel injection actually begins when the throttle pulses are allowed to start the counting of the ring counter and terminates when the ring counter counts around to its starting point. At start up of the engine throttle pulses are allowed to enter the ring counter only after the occurrence of the first rotor pulse following the termination of the prior 300 ms gating time interval. The foregoing provides for synchronization of the system.

It is to be clearly understood that the 300 ms time intervals occur cyclically and function only to update the system with respect to the advance or retard of the beginning of ignition and the time duration of the fuel injection. This updated information is then used to control the ignition timing of each of the four pistons as the rotor passes by each of the four corresponding HET's. It is to be understood that the beginning and time duration $T_x$ of the fuel injection and the burning thereof remains the same for all four pistons until the next updated information is obtained at the end of the next 300 ms time interval (an arbitrary time interval) and supplied to the ignition controller (IC) logic of the system.

The various signals which control the beginning and duration of the fuel injection period are supplied to the four injection controllers 105, 106, 107, and 108, which are primarily associated with piston #1, #3, #4, and #2, respectively. (The inputs 140–143 of IC's 105–108 are supplied to the high voltage input terminals 56 of the prior art IID of FIGS. 1 and 2 in the form of the invention employing such IID's.

It is to be noted that pistons #1, and #4 are companion pistons, as are pistons #2 and #3, a result of normal engine crankshaft construction, in that they rise and fall together, i.e. they move together synchronously. Also, they have opposite firing cycles by 180° and have a controlling factor on each other's fuel injection period. The two companion pairs of pistons and their respective HET's operate as companions generally in the following manner. Consider pistons #1, and #4. As the magnetized rotor 109 of FIG. 3 passes HET #1 in a clockwise direction, a pulse will be generated because of the Hall Effect. Such pulse will be supplied to injector controller 105 via lead 104 to energize a latch in controller 105 which will cause a high voltage to be supplied to the E-R fluid control electrode 56 of FIG. 2, thereby causing the E-R fluid therein to become solidified and preventing the injection of any fuel into the #1 cylinder chamber.

If there is to be an advance a signal will be supplied to the advance/retard input of IC 105 from advance/retard logic 118 (FIG. 3) before the rotor 109 passes HET #3 when piston #1 is at its bottom dead center (BDC) as shown in waveform A of FIG. 6. Assuming the advance to be 12° (an arbitrary figure) the injection of fuel will begin 12° of ECR before rotor 109 passes HET #3 and after a waiting period $Y=ms/180°-T$ after rotor 109 passes HET #1. The fuel injection and burning will then continue for the duration of the fuel injection period to be calculated by ring counter 170 and associated logic of FIG. 9.

On the other hand, if the advance/retard logic 118 calculates that there is to be no advance and $Y=ms/180°-T$, where $T=0$, then the fuel injection will begin when rotor 109 passes HET #3 at which time a pulse will be generated by the logic of FIG. 9 (to be discussed later herein), which enables the ring counter 170 to receive throttle pulses, disabling the high voltage to the E-R fluid of the IID and thereby allowing fluid to be injected in cylinder #1. After completion of the ring count the high voltage will be restored and the E-R fluid of the IID of FIGS. 1 and 2 will be solidified so that fuel injection ceases. If $T=0$ (the retard condition) fuel injection will begin into cylinder #1 as rotor 109 passes HET #3 (by the logic of FIG. 9). The unlatching of IC 105 which occurs when the rotor 109 passes HET #4 and will permit piston #1 (and IID #1) to go through its exhaust and intake strokes.

It is to be noted that the throttle of IC 105 of FIG. 3 is the ring counter 170 whose time duration is generally inversely proportional to the degree of depression of the accelerator and determines the time duration $T_x$ of the fuel injection, as discussed generally above, and which will be discussed in more detail in connection with the discussion of FIGS. 5 and 9.

As will be discussed in much more detail later herein, the 0.01 pulse train supplied to one input of IC 105 functions to count down to zero the value (in 0.01 ms pulses) stored in the injection initiate (count down) register 262 of FIGS. 5 and 9 and which was previously transferred thereto from the register 230 of the advance/retard logic of FIG. 4. The time required for the count down of register 262 of FIGS. 5 and 9 determines the amount of advance or a retard condition by signalling the beginning of the fuel injection, all of which will be discussed in general in connection with the following discussion of FIG. 5 and in more detail in connection with the discussion of FIG. 9 later herein.

VI. A GENERAL BUT SOMEWHAT MORE DETAILED DESCRIPTION OF THE INVENTION—FIGS. 4, 5 AND 6

For a somewhat more detailed description of the various major sections of the invention, reference is made to FIGS. 4 and 5 which fit together as shown in FIG. 5*a*.

VI.A. DESCRIPTION OF FIG. 4

FIG. 4 shows the broad logic of the tachometer and FIG. 5 shows the broad logic of the injector control (IC) logic and the throttle pulse generating logic.

Referring now specifically to logic block 225 of FIG. 4 there are six inputs supplied thereto to produce an output on cable 122 which comprises the total rotor counts during the 300 ms interval supplied from decade counter 102 of FIG. 3 via lead 103, one of the six inputs to logic block 225.

The four inputs 210–213 are supplied from the four HET'S of sequencer 111 through OR gate 116 and the sixth input lead is supplied to decade counter reset logic 202 from HET #1 of sequencer 111. A second output lead 219 supplies, through logic 202, the signal from HET #1 to reset decade counter 102 of FIG. 3. The rotor pulse sum is supplied from logic 225 via lead 122 to an input of advance initiate injection computer 228 of the injection/advance-retard logic 185 of FIG. 4, and also to the input of rotor count comparator 242 of logic 185.

Logic block 227 (an accumulator and an arithmetic logic device) receives an input signal consisting of a train of 0.01 ms pulses on input lead 252 from the decade counter 102 of FIG. 3 and then, under control of gates 218 and 220, functions to compute the number of 0.01 ms/degree of ECR. Gates 218 and 220 are, respectively, an ON gate and an OFF gate with ON gate 218 responding to pulses from either HET's #1 or #4 to enable 0.01 ms pulse accumulator 227 and OFF gate 220 responds to pulses from either HET 2 or #3 to disable accumulator 227 from accepting additional 0.01 ms pulses.

Since the engine crankshaft (EC) rotates 180° during the time the rotor 109 passes form HET #1 to HET #3 or from HET #4 to HET #2 the number of 0.01 ms pulse accumulated during each of these two separate periods is the number of 0.01 ms pulses per 180° of ECR (ms/180°). The value ms/180° is then computed from the foregoing data, e.g., the number of 0.01 ms pulses/180° and then transferred to register 230 of injector timer advance/retard logic 185. As indicated above the logic block 227 also contains divider logic which divides the value ms/180° by 180° to obtain the value ms/deg of engine crankshaft revolution (ECR) which is then supplied to the computer logic 228 of the injector 5 timer/advance retard logic 185.

The computer 228 of logic section 185 computes the value of the advance $T=MV^2$ (ms/deg) and the value of the constant M in accordance with the following expressions:

$$F=McV^2/V \quad \text{(Exp. 1)}$$

$$T=F\times R \quad \text{(Exp. 2)}$$

$$T=McV^2 \quad \text{(Exp. 3)}$$

where

F=centripetal force,

V(in ms/deg)=velocity of a mass particle at the perimeter of the arc.

r=radius of rotation

T=torque (exerted).

In order to dynamically and continuously compute the value T the mathemetical premises set forth herein are adopted.

It is assumed that the sustainable degree of angular advance before the top dead center (TDC) position of the piston for a particular type engine is reached is a function of the force (torque) developed at any given RPM in that particular type engine.

In this analysis T is expressed in degrees, although it is measured in a number of 0.01 ms pulses in the structure of FIG. 4, V is represented by the number of HET sequencer pulses occurring in a 300 ms time frame, and M is a derived constant for a unique class and type of engine.

A value for T must first be empirically determined (or measured) at a constant RPM. When that value of T is substituted in Expression 3, and also the HET pulses squared ($V^2$) for that value of RPM, the value M can be calculated which then becomes a constant for that engine type and class.

EXAMPLE

Let 15 of ECR be the maximum advance supportable for a given engine at 4500 RPM, and $T=D_A$=degrees of advance where $$T=D_A=M\times V^2, \text{ and} \quad \text{(Exp. 4)}$$

$$V=RPM(N/2)Z/60 \quad \text{(Exp. 5)}$$

where

RPM=ECR/minute,

N/2=number of rotor pulses/each ECR, and

Z=the 300 ms time frame,

Then, from Exp. 5

$$V=4500(4/2)3/60=45.0$$

Thus $T=D_A=15°=M(45^2)$ and $M_c=15°/2025=0.0074$ (a constant).

As another example, let RPM=3500;

Then V=30 and $T=D_A=0.0074\times(30^2)=6.66°$.

Reference is made to pages 113 through 128 of a publication entitled PHYSICS—U.S. NAVAL ACADEMY, Edition 1941, by Hausman-Slack and published in 1941 by the D. Van Mostrand Co. publishing company, for a full discussion of the derivation of the expression for T and particularly for the derivation of the value M, and which is incorporated herein by reference in its entirety.

The decision to advance or retard is determined by a comparison of changes in the rotor and throttle counts at the end of the current 300 ms parameter updating period compared with the number of rotor and throttle pulses determined at the end of the previous 300 ms parameter updating period in accordance with the truth table of FIG. 10*a*, and is implemented by the logic in block 240 which is shown in detail in FIG. 10, to be discussed later herein.

It is to be noted that rotor and throttle count comparators 242 and 139 of FIG. 4 both contain logic for storing the rotor and throttle counts of the previous 300 ms time interval, and comparator means for comparing the present number of rotor and throttle counts, and with the results thereof being supplied to decision logic 240.

The output of decision logic 240 is supplied to monostable switch 232 to permit or prohibit the transfer of the amount of advance calculated in computer logic 228 to logic 230.

If the calculated advance is permitted to be transferred to logic 230, then such advance will be subtracted from the value ms/180° of ECR stored in logic 230. Logic 230, in addition to including a register for storing the value ms/180°, also contains subtract logic which is capable of, and will, subtract the computed advance T from the value ms/180° to obtain the value Y, which is the number of degrees of ECR, measured in a number of first pulses, required after the rotor passes the HET (assumed to be HET #1) of the piston to be fired (assumed to be piston #1) and is computed as follows: (for a four cylinder engine);

$$Y = ms/180° - T$$

The rotor 109 of FIG. 3 must then rotate Y degrees of ECR after passing the relevant HET #1 at which time fuel injection and burning thereof begins.

The output Y of logic 230 is supplied to the injection initiate control register 262 of the IC of FIG. 9 of the piston being fired (assumed to be piston #1), as shown generally in FIG. 3, via cable lead 137, and as shown specifically in FIG. 4, via cable 234.

Consider now the function of decision logic 240 of FIG. 4 and its relation to the interaction of logic 228 and 230 to control the monostable ON switch 232. More specifically, decision logic 240 indicates whether an advance is to be prohibited or allowed in that a retard is to occur by means of comparing the changes in rotor and throttle counts during the current 300 ms time interval with the rotor and throttle counts accumulated during the immediately prior 300 ms time interval. In the later event (retard) the monostable switch 232 is open (nonconductive) and the advance calculated in computer 228 is not transferred to logic 230. Thus, there will be no subtraction of the calculated advance T in logic 230 and the value Y computed in logic 230 will be supplied to injection initiate register 262 of the IC of FIG. 9 will be:

$$Y = ms/180° - (T=0) = ms/180°$$

Accordingly, the fuel injection to cylinder #1 will not begin until the ECR = 180° and the rotor 109 passes HET #3 (due to the logic of FIG. 9) when piston #1 is at its TDC, as shown in waveform A of FIG. 6. This fuel injection will continue for the calculated fuel injection time interval $T_x$ (discussed later herein) and which will terminate before piston #1 reaches it bottom dead center (BDC) at time t of waveform A of FIG. 6.

VI.B. DETAILED DESCRIPTION OF FIG. 5

When an advance is required the beginning of the fuel injection begins at the time $Y = ms/180° - T$ before rotor 109 (FIG. 1) passes HET #3, as indicated above.

The injection control unit of FIG. 5 consists of a bistable switch 250, a monostable switch 274, a parallel-set injection initiate count down register 262, a ring counter 170, and an SCR activated high voltage generator 284 activated by SCR driver 254.

The bistable switch 250 is turned on by a latching pulse supplied by an HET, or pulse producing device (PPT), of the sequencer 111 of FIG. 3 associated with the cylinder to be fired. Turn off is made by the unlatch pulse from the companion cylinder (#4 in the example being discussed). Turn on of the bistable switch 250 causes voltage to be supplied to SCR 254 via lead 256. SCR 254 is already receiving a chopping pulse via lead 280 from the decade cascade 102 of FIG. 3 through the monostable "ON" switch 274. These conditions cause a chopped voltage to be impressed via lead 282 on the primary winding (not shown) of a high voltage transformer in high voltage generator 284. The secondary winding thereof (not shown) supplies the high voltage to the fuel injector terminal 56 (shown in FIG. 2) via lead 286.

At the time of turn-on of bistable switch 250 the contents of register 230 of A/R computer 185 (FIG. 4) are transferred by a transfer enable pulse to the count down register 262 of FIG. 5 which immediately begins to serially count down in response to the 0.01 ms pulses supplied thereto through lead 113 and AND gate 260, and upon the occurrence of a latching pulse being supplied via lead 244 to turn on bistable switch 250 and thereby prime AND gate 260.

At the end of the count down when down-counter 262 reaches zero, a signal is supplied which will enable throttle ring counter 170 via leads 268, and which will disable monostable ON switch 174 via leads 268 and 269, logic 273, and lead 272 to prevent the 1 ms pulses on lead 276 from passing through switch 274 to create a chopper pulse train which would then pass through SCR driver 254 via lead 280 to generate a high voltage in high voltage generator 284 via lead 282. The prevention of such high voltage allows fuel injection to occur.

At the end of the count of ring counter 170 back to its starting point the logic of FIG. 9 will function to disable ring counter 170, thereby preventing additional throttle pulses from being entered therein until it is again enable during the next succeeding cycle of firing timing. Also, count down register will be disabled via lead 266 and monostable ON switch 274 will resume its "ON" state via logic 273, as will be discussed in FIG. 9.

Because of the above-described logic and the additional detailed logic shown in FIG. 9, down counter register 262 will be enabled only during the time intervals required to receive the calculated advance and fuel injection data and during the immediately following count down to zero value. Similarly, ring counter 170 is enabled to count only during the time interval beginning with the zero count-down value of counter register 262 and the end of the ring count of ring counter 170.

Throttle pulses of a variable frequency are supplied to ring counter 170 continuously from a free running multivibrator 435 (FIG. 9). The frequency of such throttle pulses is determined by a variable capacitor 441 of FIG. 9 whose value in turn is controlled by the throttle rod 437.

As has been noted above, the farther down the accelerator (not shown) is depressed the lower the frequency of the throttle pulses, thereby increasing the length of time it takes the ring counter 170 to complete the count around its ring and therefor provide a longer fuel injection time interval $T_x$. Other structures can, of course, be devised to derive the time interval $T_x$ from the position of the accelerator.

VI.C. DETAILED DESCRIPTION OF FIG. 6

Timing diagrams showing the general timing relationship of the latching, injection, and unlatching, with respect to the four strokes of the piston, the compression stroke, the power stroke, e.g., the exhaust stroke, and the intake stroke are shown in FIG. 6 for all four pistons. The symbols "BDC" and "TDC" are acronyms for "Bottom Dead Center" and "Top Dead Center," respectively, of the four pistons #1-#4 shown in the timing diagrams A, B, C, and D of FIG. 6. Timing diagram E of FIG. 6 shows the maximum possible advance time and the maximum fuel injection interval for a given engine cylinder.

It is to be noted in FIG. 6 that companion pistons #1 and #4 rise and fall together in synhrohnism as do companion pistons #2 and #3. However, the injection times of companion pistons #1 and #4 are spaced apart a full revolution (360°) of the crankshaft (or 180° revolution of the rotor) as do companion pistons #2 and #3. Also note that the rise and fall of pistons #1 and #4 in diagrams A and D are displaced from the rise and fall of pistons #2 and #3 by 180° of revolution of the engine crankshaft, as are the fuel injection times. The order of fuel injection can be seen to be spaced apart 180° of the ECR and have the following firing sequence: piston #1, #3, #4, and then #2 as shown in timing diagrams A, C, B, and D, respectively.

The corresponding rotor positions and the amount of ECR are shown at the top of FIG. 6 with respect to the latching, unlatching, and fuel injection for each piston. For example, the #1 piston of diagram A of FIG. 6 is at its BDC when the rotor is passing HET #1 and when the crankshaft is at 0° rotation. At this time the IC of piston #1 becomes latched (supplying a high voltage to the associated IC to freeze the E-R fluid and thereby prevent fuel injection at the beginning of the compression stroke.

Piston #4, the companion of piston #1, is unlatched (removing the high voltage to unfreeze the E-R fluid and allow fuel injection) and at its BDC at this initial time and further is at the beginning of the exhaust stroke of piston #4. Pistons #2 and #3 are respectively at their TDC with fuel injection occurring in the cylinder chamber of piston #2 to cause it to enter its power stroke and with piston #3 also being at TDC and about to enter its intake stroke.

As indicated above, waveform E of FIG. 6 shows the maximum advance, beginning at time t of piston #3 (arbitrarily selected) and with the maximum duration ending at time t. It is to be noted that if the fuel injection has no advance it will commence at time t, with a time duration ending not later than the unlatch time $t_z$. The advance can begin at any point between time $t_w$ and $t_x$ and the duration of fuel injection can end at any time prior to time $t_z$.

The unlatching at time $t_z$ is significant in that it allows piston #3 to perform its exhaust and intake strokes (no fuel is in the cylinder #3 at this time) and functions to insure the latching of its companion piston #2 in preparation for the compression stroke of piston #2, and to allow the IID #3 (see prior art FIGS. 1 and 2) to return to a condition where more fuel can be stored therein in preparation for its next following compression and power strokes of piston #3 to occur.

In fact, the unlatching of the IC of piston #3 is caused by the latching of the IC of piston #2 as can be seen graphically from the timing diagrams B and C of FIG. 6, and the logic of FIG. 3 wherein the latching of IC 106, as the rotor 109 passes HET #2, via lead 129, causes the unlatching of IC 107 via lead 129. The unlatching of IC 107 prevents the further generation of a high voltage in IC 107 of FIG. 3, thereby preparing for the injection of fuel in the associated cylinder chamber during the next compression stroke of piston #3 when the rotor 109 of FIG. 3 passes HET #3 again. It is to be remembered that the rotor 109 of FIG. 3 will only pass any HET, including HET #3, once during every two revolutions of the engine crankshaft (ECR). In the four cylinder engine example being employed herein, there are four IID's and four HET's, one for each cylinder.

VII. DETAILED DESCRIPTION OF INVENTION—FIGS. 7, 8, 9, 10 and 10*a*.

A more complete and comprehensive understanding of the organization and interrelation of various parts of FIG. 3 can be obtained by the following consideration of FIGS. 7, 8, 9, 10, and 11.

VII.A. DETAILED DESCRIPTION OF FIG. 7

As mentioned briefly above the tachometer 100 of FIG. 3 functions primarily to continuously update the computation of the ms/deg of each revolution of the engine crankshaft (ECR), with the aid of the rotor pulses, and also to count the rotor pulses over a periodic time interval of 300 ms. The detailed logic of the tachometer 100 is shown in FIG. 7 which will now be described in detail below.

Decade counter 102 of FIGS. 3 and 3*a* supplies a continuous train of 0.01 pulses to input 300 of 0.01 ms pulse accumulator 302. However, such 0.01 pulses are accumulated only during the time periods when the rotor passes between HET #1 and HET #3 and between HET #4 and HET #2, with each period representing 180° of a revolution of the engine crankshaft. It is to be noted that the combination of the HET's and the rotating rotor is referred to herein as the "sequencer," and is identified by reference character 111 in FIGS. 3 and 7.

In order to accumulate 0.01 ms pulses only during the time periods that the rotor 109 (FIG. 1) passes between HET's 1 and #3 and HET's #4 and #2, it is necessary to disable accumulator 302 of FIG. 7 during the time periods rotor 109 (FIG. 3) passes between HET's #3 and #4 and HET's #2 and #1. This is accomplished by means of logic including sequencer 111, OR gates 304 and 306, and flip-flop (FF) 308.

When a pulse is generated by rotor 109 (FIG. 3) passing either HET #1 or HET #4, flip-flop (FF) 308 is set by such pulse passing through OR gate 304, thereby enabling accumulator 302 and allowing it to begin accumulating the 0.01 ms pulses supplied thereto from decade counter 102. However, when a pulse is generated by rotor 109 passing HET #3 or HET #2, such pulses will pass through OR gate 306 to reset FF 308 and disable accumulator 302 from accumulating additional 0.01 ms pulses. Thus, when the rotor 109 has rotated from HET #1 to HET #3 it has accumulated 0.01 ms pulses over time period equal to 180° of engine crankshaft revolution (ECR) (ms/180°) and then repeats such accumulation between HET's #4 and #2.

In order to compute the ms/deg of ECR it is necessary to transfer each accumulation of ms/180° pulses from accumulator 302 to arithmetic dividing unit (AU) 310 where the ms/180° is divided by 180° to obtain the ms/deg value. It is to be noted that it is necessary to enable arithmetic unit (AU) 310 to accept the ms/180 accumulated in accumulator 302 and then, by other means, to clear accumulator 302 in preparation for the accumulation of the next group of 0.01 ms pulses as the rotor 109 passes form HET #4 to HET #2.

Such transfer of the contents of accumulator 302 to AU 310 is accomplished by the pulse generated by rotor 109 as it passes HET #3 or HET #2, i.e., the pulses appearing at the output of OR gate 306 via lead 312 of FIG. 7. The clearing of the accumulator is accomplished by pulses generated as rotor 109 passes HET #1 and #4 via lead 314 and then supplied through OR gate 304. The calculated ms/deg is then supplied to the advance retard (A/R) logic of FIG. 8 where it is utilized in a manner which will be discussed in conection with the description of the A/R logic of FIG. 8 later herein.

Returning to FIG. 7 the number of sequencer (or rotor) pulses generated during each periodic 300 ms interval is determined as follows. Assume decade counter 102 has just been reset to zero by a reset pulse 320, (occurring when rotor 109 of FIG. 3 passes HET #1) of timing diagram A of FIG. *7a* and supplied thereto via and gate 316 lead 113, pulse shaper 334, and lead 219. This reshaped reset pulse from pulse shaper 334 will also set FF 344 (waveform G of FIG. *7a*) to enable sequencer (rotor) pulse accumulator 100 to accumulate rotor pulses generated as the rotor passes each of the four HET's of sequencer 111.

When the decade counter 102 (FIG. 3) outputs a pulse 371 marking a time interval of 300 ms after being reset, as shown in waveform B of FIG. *7a*, such 300 ms time interval marking pulse (which itself has a duration of 100 ms, also as shown in waveform B of FIG. *7a*, is supplied to the reset input 320 of FF 344 (and also to the set input 322 of FF 326), with the trailing edge 373 (waveform B of FIG. *7a*) resetting FF 344 which had been previously set by the cascade reset pulse. It is to be noted specifically the 300 ms time period is measured by the trailing edge of the second pulse in the 100 ms pulse counter section of the decade counter, each of which pulses is 100 ms in length. The trailing edge of the second 100 ms pulse occurs when the decade counter has counted through 100 ms three times. Rotor pulse accumulator 100 will accumulate rotor pulses during the time period of 300 ms when accumulator 100 is activated.

The next decade counter reset pulse following the 300 ms period discussed immediately above cannot be generated either immediately upon the termination, or overlap the termination, of the current 300 ms period in order to avoid a race condition. More specifically the beginning of a new 300 ms time interval or period must be delayed until the completion of the necessary computations (following the preceding 300 ms time interval) which are required to determine whether an advance or a retard is required and also the duration of the injection time of fuel. A premature rotor pulse from HET #1 (pulse 374 of waveform D of FIG. 10) could otherwise cause a premature beginning of a new 300 ms period.

To avoid such a timing conflict with a resulting mistiming, a 10 ms length pulse 373 (waveform C of FIG. *7a*) is selected from the decade counter 102 which immediately follows the 300 ms gating pulse 371 as shown in waveform C of FIG. *7a*. This 10 ms pulse is supplied to one of the two inputs of OR gate 330 along with the set output of FF 326 (waveform D of FIG. *7a*.)

It will be recalled that the decade counter 102 cannot be reset to begin generating another 300 ms pulse until after rotor 109 passes HET #1 in order to maintain the proper timing of the system which will become clearer in connection with the discussion of the A/R logic of FIG. 8 later herein.

To accomplish the foregoing, any output pulse from OR gate 330 will inhibit the occurrence of a decade counter rest pulse from AND gate 316 as shown in waveforms F and G of FIG. *7a* where the output pulse 375 of AND gate 216 cannot begin until after the termination of the 10 ms pulse 372 (waveform C). The occurrence of the trailing edge 370 of the pulse 371 of waveform B of FIG. *7a* to reset FF 344 must also occur before the rotor pulse from HET #1 can pass through AND gate 316.

In summary, the inhibition of a decade reset pulse from AND gate 316 will exist during the 300 ms period, and the immediately following 10 ms period, thereby preventing a master rotor pulse, which occurs when rotor 109 (FIG. 1) passes HET #1, from passing through AND gate 316 during the existence of the 300 ms period followed by a 10 ms period. It should be noted that AND gate 316 is primed by the resetting of FF 324 upon the occurrence of the trailing edge 370 of the 100 ms gating pulse 371 and would pass the master HET #1 pulse except for the inhibiting effect of the output or OR gate 330. In the event a master rotor pulse from HET #1 begins during the 10 ms pulse 372 (waveform C of FIG. *7a*) following the 300 ms gating period, as shown in waveform E of FIG. *7a* and then terminates after the expiration of the 10 ms pulse, the pulse shaper 334 is provided to reshape that portion of the master rotor pulse (pulse 375 of waveform F of FIG. *7a*) which passes through AND gate 316 into the wider, reshaped pulse 376 of waveform G of FIG. 7 to insure that it will be sufficient to reset cascade counter 102 and set FF 344. Also, in FIG. 7, the sequencer pulses from HET's #1, #3, #2, and #4, as the rotor passes by each HET, are supplied respectively to IC's 105–108, as in also shown in FIG. 3, and for the purposes described in the above discussion of FIG. 3.

VII.B. DETAILED DESCRIPTION OF FIG. 8

Referring now to FIG. 8 which is a detailed description of the logic of the advance/retard logic 185 of FIG. 4 the set and reset outputs of FF 344 of FIG. 7 are supplied to FIG. 8 via leads 342 and 340 where they are each connected to a number of inputs. Essentially, the signals appearing on leads 342 and 340 perform, enable and disable functions as will be discussed in detail along with the following discussion of the logic blocks of FIG. 8 and their interrelation.

As discussed above, the number of rotor pulses accumulated in accumulator 100 of FIG. 7 during each 300 ms interval of time is supplied to the advance initiate injection computer (AIIC) 346 of FIG. 8 via lead 345 by means of a transfer enable pulse supplied to transfer enable input 358 of AIIC 346 of FIG. 8 via lead 340 upon the resetting of FF 344 of FIG. 8. Also the value ms/180 accumulated in register 302 of FIG. 7 and the ms/deg calculated in divider logic 310 of FIG. 7 are supplied via leads 350 and 352, respectively, to subtract logic 354 and AIIC logic 346 of FIG. 8, respectively, upon the transfer enablement of logic blocks 354 and 346 of FIG. 8 by the enabling signals appearing on leads 342 and 340, respectively, and which are supplied to transfer enable inputs 356 and 358 of logic blocks 354 and 346, respectively, of FIG. 8.

Consider now the function of each of logic blocks 354 and 346. Logic block 346 comprises computer logic which computes the advance value $T=MV^2$ in (ms/deg), where M is a constant which is determined empirically for each of the various types of automobile engines made today and is determined by the number of cylinders, the cubic displacement of each cylinder, and other parameters as will be discussed in detail herein.

Assume firstly that there is to be an advance which is determined by the logic below the dashed line 369 in FIG. 8 (and to be described later herein) and which controls the normally ON monostable switch 232 through AND gate 357.

In response to the decision to advance the subtract logic 354 will subtract the value T (the amount of advance) from the value ms/180° in subtract logic 354. Switch 232 will be conductive to pass the value T to subtract logic 354. As will be recalled the value ms/180° is obtained from register 302 of FIG. 7 via lead 350.

Using piston #1 as an example, it is necessary to subtract T from ms/180° since the advance timing for the firing of piston #1 begins at a time T before the rotor passes HET #3. More specifically, fuel injection and ignition thereof will not begin until piston #1 approaches its TDC which occurs as rotor 109 approaches HET #3. When the rotor is T time before passing HET #3, which is $Y=ms/180°-T$ time from the time the rotor passed HET #1, fuel injection and ignition thereof will begin. Worded in another manner, injection and ignition of the fuel will not begin until the ignition initiate down counting register 262 of FIG. 9 is down counted to zero which, in the case of an advance, occurs before rotor 109 reaches HET #3 or, in the case of a retard, occurs when the rotor passes HET #3 for reasons set forth generally below.

The foregoing is shown more clearly in sequencer 111 of FIG. 3 wherein timing begins as rotor 109 passes HET #1 but firing does not begin until rotor 109 reaches the angular position indicated by radial line 121 (FIG. 3) which is 12° (of ECR) before rotor 109 reaches HET #3.

Since the engine shaft has rotated 180° during the 90° angular rotation of rotor 109 between HET #1 and HET #3, and since fuel injection into cylinder #1 has been calculated to begin 12° of ECR before rotor 109 reaches its TDC as it passes HET #3, it is necessary to subtract T (in ECR degrees of rotation) from 180° of ECR degrees of degree, resulting in 168° of ECR (or 84° of rotor 109 rotation measured from the time rotor 109 passes HET #1). Thus, initiation of fuel injection will begin 12° of ECR or 6° of rotor rotation before the rotor passes HET #3, as shown by radial 121 of sequencer 111 of FIG. 3. If there were no advance, but rather a retard was called for, the rotor 109 (FIG. 3) would have to rotate through a full 180° of ECR or 90° of rotor revolution and fuel injection would begin as rotor 109 (FIG. 3) passed HET #3.

It should be noted that the output of subtract logic 354 of FIG. 8, which is in 0.01 ms pulse/180° of ECR minus the value T, is always supplied via output lead 334 to count down register 262 of FIG. 9 which then immediately begins to count down to zero, at which time fuel injection begins in a manner determined by the throttle position, as will be discussed in detail in connection with FIG. 9. Thus, if T is not subtracted from ms/180° in subtract logic 354 of FIG. 8, count down register 262 must count down a full 180° of ECR in 0.01 ms pulses, and there will be no advance. The fuel injection will begin as rotor 109 passes HET #3 which will occur after 180° of ECR or 90° of rotor rotation.

On the other hand, if T is subtracted from the value ms/180° in subtract logic 354 the result entered into count down register 262 of FIG. 9 will be less than 180° of ECR in 0.01 ms pulses and an advance of T° (in 0.01 ms pulses) will occur. The fuel injection will then begin before rotor 109 (FIG. 3) passes HET #3.

Ignition of the fuel will begin immediately upon the beginning of fuel injection and will continue for the calculated duration of fuel injection which is determined by the throttle pulse frequency as will be discussed in more detail in connection with FIG. 9.

When rotor 109 (FIG. 3) passes HET #3 it will create a pulse which will latch IC 107 of FIG. 3 and initiate the timing of the ignition cycle of the fuel in cylinder #3. Piston #3 will be at its BDC, as shown in waveform C of FIG. 6. Assuming the advance and fuel injection interval to remain the same as for the firing of piston #1, fuel ignition in cylinder #3 will begin 12° (of ECR) before rotor 109 reaches HET #4. Also, as rotor 109 passes HET #3, EC 106, associated with the companion HET #2, will be unlatched allowing piston #2 to go through its exhaust and intake cycles between times $t_1$ and $t_3$ of waveform B of FIG. 6.

As indicated above, at the end of the next 300 ms time interval, newly calculated parameters of the advance (or retard) and the duration of fuel injection will be supplied to the four IC's 105, 106, 107, and 108 of FIG. 3.

The four outputs 140, 141, 142, and 143 of IC's 105, 106, 107, and 108, respectively, as mentioned above, supply a high voltage to the high voltage inputs 56 of the four CAFI'S of the type shown in FIGS. 1 and 2 of the previously mentioned patent application Ser. No. 904,378 to freeze the E-R fluid therein and thereby prevent injection of fuel into the associated cylinders. In the absence of such high voltage the four CAFI'S of FIGS. 1 and 2) will permit the fuel to be injected into the cylinder firing chambers.

Such supplying of high voltage is supplied to the terminals 56 (FIG. 2) of the four CAFI'S (FIGS. 1 and 2) in accordance with the waveforms of FIG. 6, when the CAFI'S are in an unlatched condition, and is removed from the CAFI'S when the CAFI'S are in a latched condition, as shown in the waveforms of FIG. 6.

Consider now the case where a retard condition rather than an advance condition is required. Switch 232 will be non-conductive and the output of subtract logic 354 of FIG. 8 will be the value ms/180° (in 0.01 ms pulses), since the value T cannot be subtracted therefrom due to the non-conductivity of switch 232. Therefore, a high voltage will be supplied to the terminals 56 (FIG. 2) of the four CAFI's of FIGS. 1 and 2 when the count down register 262 of FIG. 9 counts down from 180° to 0°, discussed briefly above and which will be discussed in detail later herein in connection with the discussion of FIG. 9.

When count down register 262 has counted down to 0° from 180° (of ECR in 0.01 ms pulses), the rotor 109 of FIG. 3 will be passing HET #3, as discussed above.

The logic below the dashed line 369 in FIG. 8 will now be discussed. As indicated above such logic controls the decision to cause switch 232 of FIG. 8 to be either conductive (ON) or non conductive (OFF). Basically, the logic below the dotted line 369 periodically accumulates the total number of rotor and throttle pulses over a given time interval Z, which will be assumed to be 300 ms in the present example of operation, in registers 100 and 341, respectively. These accumulated rotor and throttle pulses will then be compared in comparators 357 and 343 and the total number of rotor and throttle pulses accumulated in the immediately prior 300 ms time interval. The relative changes in the number of rotor and throttle pulses are then compared and processed in decision logic 240 in response to the signal appearing on one of the three outputs of the two comparators 357 and 343 which will indicate whether the number of rotor and throttle pulses have each decreased, remained constant, or increased.

Then, in accordance with the truth table 380 of FIG. 10*a* either a permit or a prohibit output signal will be generated on either the output lead 339 or the output lead 343 or OR gate 312 or 314, respectively, as will be discussed in more detail in connection with the description of FIG. 10.

Comparators 357 and 343 are enabled at the end of the 300 ms time interval which resets FF 344 of FIG. 7, with the reset output being supplied to the enable inputs of comparators 357 and 343 via lead 340. When the next decade reset pulse occurs FF 344 (FIG. 7) is set to cause the transfer of the contents of rotor pulse register 100 and throttle pulse register 341 to registers 353 and 345, respectively, via leads 367 and 344, in preparation for a comparison of the next accumulation of rotor and throttle pulses in registers 100 and 341 after the next 300 ms time interval updating period.

VII.C DETAILED DESCRIPTION OF FIG. 9

The injection control unit of FIG. 9 which uses the same reference characters used in FIG. 5 to identify corresponding elements, consists of a bistable switch 250, a monostable switch 274, a parallel-set down counter register 262, a ring counter 170, and a high voltage generator 184 activated by SCR driver 254.

The bistable switch 250 is turned on by a latching pulse via lead 244 from the sequencer associated with the cylinder to be fired. Turn off of bistable switch 250 is caused by the unlatch pulse from the HET of the companion cylinder via lead 246. Turn on of bistable switch 250 causes an output voltage to prime AND gate 260, and to prime SCR 254 via lead 256. SCR 254 also is receiving a ms chopping pulse via lead 280 from the decade cascade counter 102 of FIG. 3 through the monostable "ON" switch 274. These conditions cause a chopped voltage to be impressed, via lead 282, on the primary winding of a high voltage transformer in high voltage generator 284. The secondary winding thereof supplies the high voltage to the fuel injector (not shown in FIG. 9) via lead 286.

At the time of turn on of bistable switch 250 the contents of register 234 of A/R computer 185 (FIG. 4) are transferred by a transfer enable pulse 420 of waveform A of FIG. 9*a* (via lead 234) to the count down register-counter 262 of the IC of FIG. 9, which immediately begins to serially count down (as indicated in waveform B of FIG. 9*a*) in response to the 0.01 ms pulse train supplied thereto through lead 113 and AND gate 260 of FIG. 9, upon the occurrence of a latching pulse being supplied, via lead 244, to turn on bistable switch 250 and thereby prime AND gate 260.

At the end of the count down, when counter-register 262 reaches zero, a signal is supplied which will set FF 488 (waveform E of FIG. 9*a*) to enable throttle ring counter 170 via enable input 490, to disable monostable ON switch 274 via lead 272 to prevent the 1 ms pulses on lead 176 from passing through switch 274 to create a chopper pulse train which would then pass through SCR driver 254 via lead 280 to generate a high voltage in high voltage generator 284 via lead 282 and finally, to set FF 489 (waveform F of FIG. 9*a*) to clear and disable down counter-register 262 until the next transfer enable pulse (from subtract logic 354 of FIG. 8) is supplied via lead 334 to reset FF 489. Also, when down counter 262 reaches zero, FF 420 is reset to disable AND gate 260 and thus disable count down register 262.

At the end of the count of ring counter 170 back to its starting point an output is supplied from terminal 495 of ring counter 170 via lead 492 to reset FF 488 and to disable ring counter 170, thereby preventing additional throttle pulses from being entered therein until ring counter 170 is again enabled during the next succeeding cycle of firing timing. Also, monostable ON switch 274 resumes it "ON" state.

Because of the above-described logic, down counter register 262 is enabled only during the time interval required to receive the calculated advance and fuel injection data and during the immediately following count down to zero value (waveform B of FIG. 9*a*). Similarly, ring counter 170 is enabled to count only during the time interval $T_x$ (which is the fuel injection time interval) beginning with the zero count down value of counter register 162 and terminating at the end of the ring count (waveform C of FIG. 9*a*).

Throttle pulses of a variable frequency are supplied to ring counter 170 (and to throttle count pulse register 341 of FIG. 8) continuously from the free running multivibrator 435 of FIG. 9. The frequency of such throttle pulses is determined by variable capacitor 441 whose value in turn is controlled by the position of throttle rod 437.

As has been noted above the farther down the accelerator is depressed the lower the frequency of the throttle pulses, thereby lengthening the time $T_x$ it takes the ring counter 170 to complete the count around its ring and thereby lengthening the fuel injection time interval $T_x$.

VIII. ALTERNATIVE FORM OF THE INVENTION

As an alternative form of the invention a spark gap, or other suitable fuel ignition element, can be employed as the ignition agency rather than the heat generating glow wire 68 of prior art FIGS. 1 and 2 with the use of additional logic of FIG. 9 which comprises monostable OFF switch 496, SCR high voltage driver 497, and high voltage generator 498, and the substitution of appropriately spaced electrodes similar to those of a conventional spark plug in lieu of the glow wire 68 shown in FIGS. 1 and 2.

The electrodes can be connected to the same wires as is the glow wire 68 but need be supplied an arc-producing-voltage only at the beginning of the time interval that fuel injection occurs. The foregoing is accomplished by monostable OFF switch 496, which is normally off, to prevent a high voltage from being developed in SCR high voltage driver 497. It is to be noted that when monostable OFF switch 496 is off, resulting in a high voltage not being supplied to an ignition spark gap via lead 499, monostable ON switch 274 is on, thereby permitting the generating of a high voltage to cause the E-R fluid to become frozen, thus preventing fuel injection to occur.

On the other hand, when switch 274 is off, thereby permitting fuel injection to occur, switch 496 is on, thereby allowing a high voltage to be developed which is supplied across the electrodes (provided in lieu of the glow wire 68) to create a spark during the fuel injection period which ignites the fuel.

At the bottom of the power stroke of the engine cylinder the unlatch pulse is received from its companion cylinder turning off the bi-stable switch 250 via unlatching lead 246 and removing power from the SCR'S to de-energize the injector. The injector return spring (see FIGS. 1 and 2) returns its piston to the initial position thereby pulling in additional fuel in preparation for its next operation.

IX. DISCUSSION OF FIG. 10

FIG. 10 shows a detailed diagram of suitable logic for implementing the function required by logic block 140 of FIG. 8. In FIG. 10 the dashed line block 140 is divided into a prohibit advance logic portion 324 and a permit advance portion 322, both portions functioning in accordance with the truth table of FIG. 10*a*.

It is apparent from an examination of FIG. 10 that the two AND gates 316 and 318 each will produce an output when either of the prohibit conditions of FIG. 10*a* exist. Either of such outputs will pass through OR gate 314 lead 339 and then to AND gate 357 to turn off monostable ON switch 132 and thereby prevent the calculated advance T from being subtracted from 180° of ECR.

Similarly, either of the two permit conditions of the truth table of FIG. 10*a* will produce an output from one of the two AND gates 306 or 310 which will pass through OR gate 312, lead 343, and then to the inhibit input of AND gate 357 of FIG. 8 to prevent the turning off of switch 132 and thereby allow the calculated advance T to be subtracted from the value ms/180°.

While the above specification discloses a preferred embodiment of the invention, it will be apparent to one of ordinary skill in the art that various modifications and embodiments of the invention can be made without departing from the spirit or scope of the invention as defined in the appended claims.

I claim:

1. In a fuel injection type internal combustion engine comprising an acelerator, a distributor having a rotatable rotor, and N pulse producing devices each positioned at the outer end of said rotor and each of a type which will produce a rotor pulse each time said rotor passes thereby, a piston and an associated cylinder chamber with the strokes of each piston bearing a predetermined positional relation with said rotor as the rotor passes the associated pulse producing device and N fuel ignition elements each extending into the cylinder chamber, and a fuel injector device for injecting fuel directly past each fuel ignition element at predeterminable time intervals with respect to the time said rotor passes a given pulse producing device to obtain a substantially non-stoichiometric mixture of fuel and air and with said injected fuel being ignited by each fuel ignition element during the entire fuel injection time, an electronic injection system for controlling the time of beginning and the time of duration of the injection of fuel into N each of said cylinder chambers and comprising:

counter means for generating a series of pulse trains of different frequencies;

first logic means comprising a tachometer means and a computer means responsive to a pulse train consisting of first pulses of a first frequency generated by said counter means and the occurrence rate of said rotor pulses to compute the time in milliseconds per M degrees of engine crankshaft revolution, the instantaneous angular velocity of the engine crankshaft revolution per degree in time per degree at any given time, and the number of rotor pulses occurring during a given time interval Z at periodic intervals and determined by selected pulses generated by said counter means with both milliseconds per M degrees and milliseconds per degree being measured by the number of said first pulses occuring during said milliseconds per M degrees and milliseconds per degree time periods;

first means responsive to the degree of depression of said accelerator to generate a second pulse train of throttle pulses whose frequency varies with said degree of depression;

second means responsive to said frequency of said second pulse train to compute the length of time of fuel injection $T_x$;

third means for measuring the number of throttle pulses over said given time interval Z at periodic intervals;

fourth means responsive to the changes or lack of changes in the number of rotor and throttle pulses counted during each current time interval compared to the number of rotor and throttle pulses counted during the immediately prior time interval Z for determining whether an advance or a retarding of the beginning of fuel injection is required;

fifth means for calculating the amount of advance T, if required, measured from a time Y, which in turn is measured from the time of occurrence of the pulse produced by the rotor passing the pulse producing device associated with the cylinder chamber in which the fuel is to be injected;

sixth means for implementing each newly computed beginning and time of duration of fuel injection; and seventh means for resetting said counter means to zero at a predetermined short period of time after the expiration of the time interval Z.

2. In a fuel injection type internal combustion engine in accordance with claim 1, in which said fifth means comprises calculating means for calculating after the resetting of said counter means, the value $T = McV^2$ milliseconds per degree, where $V^2$ is the square of the rotor count every given time interval Z, milliseconds per degree is the milliseconds required for one degree of engine crankshaft revolution, Mc is a constant determined by various parameters and characteristics of the engine, and T is the amount of advance of fuel injection; and in which $Y = N$ milliseconds/720° $- T$, where N is the number of engine cylinders.

3. A fuel injection type internal combustion engine in accordance with claim 1 in which said first and second means comprise:

a second counter having a fixed capacity count;

means for calculating the value Y;

a countdown register for receiving the value Y after the calculation thereof has been completed and for receiving a pulse train of said first pulses which counts down the value Y in said countdown register until said count therein reaches a predetermined value;

second logic means responsive to said countdown register reaching its count of predetermined value to enable the throttle pulses to be counted in said second counter until said second counter reaches its fixed capacity at which time no more throttle pulses are allowed to be counted;

third logic means responsive to the time period $T_x$ said second counter is receiving throttle pulses to provide an output signal during said time period; and fuel injection means responsive to said output signal to inject fuel into the cylinder chamber being fired.

4. A fuel injection type internal combustion engine as in claim 3 in which said output signal is a high voltage and further in which said fuel injection means comprises:

an injector/ignitor device comprising;

eighth means for injecting fuel directly into the associated cylinder chamber;

valve means having first and second conditions for causing injection of fuel into said cylinder chamber when in said first condition and for preventing injection of fuel into said cylinder chamber when in said second condition;

ninth means for containing a body of electro-rheological fluid around said valve means with said electro-rheological fluid responsive to said high voltage, when applied thereacross, to solidify and freeze said valve in its said second condition to prevent the injection of fuel into said cylinder chamber and responsive to the absence of said high voltage to become fluid to allow the injection of fuel into said cylinder chamber, thereby determining the beginning of fuel injection and the time duration of said fuel injection; and terminal means for receiving the high voltage signal from said third logic means and to impress said high voltage across electro-rheological fluid to freeze at least a portion of the electro-rheological fluid and thereby prevent said valve from assuming its first condition.

5. A fuel injection type internal combustion engine as in claim 1 in which said fuel injector device comprises:

a fuel ignition element positioned in the path of the fuel being injected to ignite said fuel when energized; and a power source to excite said fuel ignition element to ignite the fuel at the beginning of time T.

6. A fuel injection type internal combustion engine as in claim 1 in which said fuel ignition element comprises:

a pair of electrodes positioned apart to form a gap therebetween in the path of the injected fuel;

second means for supplying a high voltage source to said electrodes across said gap, when said first high voltage is not present to thereby cause an arc to exist across said gap during the time fuel is being injected into said cylinder chamber.

7. A fuel injection type internal combustion engine as in claim 1 in which said pulse producing device is a Hall Effect transistor.

8. In a fuel injection type internal combustion engine comprising an accelerator, an engine crankshaft, N cylinder chambers, and a piston associated with each cylinder chamber, and a distributor comprising N first devices and rotatable rotor positioned to rotate past each of the first devices in sequential order and to generate a pulse each rotation past a first device, an electronic fuel injection system comprising:

N fuel injection devices, each having a fuel ignition element extending into one of the N cylinder chambers to maintain burning of the injected fuel;

a fuel injector for injecting fuel towards each fuel ignition element.at predeterminable time intervals with respect to the time the rotor passes each first device;

an electronic injection system for controlling the time of beginning and the time of duration of fuel injection into each of cylinder chambers and comprising:

a counter cascade for generating a series of frequency pulse trains each successively stepped down by a factor x;

a first counter for measuring the time required for M degrees of engine crankshaft rotation, with the time being measured by the counted number of first pulses of a predetermined frequency from the counter cascade and for determining the angular velocity of the engine crankshaft rotation at any given time in time per degree of the engine crankshaft rotation;

first logic means for determining the fuel injection time $T_x$ and responsive to the degree of depression of the accelerator for generating a train of throttle pulses whose frequency varies with the degree of accelerator depression, and for measuring the time $T_x$ which is determined by the frequency of the train of throttle pulses generated by the accelerator;

second logic means for counting and then comparing the number of rotor pulses and the number of throttle pulses occurring during a current given interval of time Z with predetermined changes in the number of rotor pulses and the number of throttle pulses counted during the immediately prior interval of time Z to determine whether an advance or a retarding of the beginning of fuel injection is required;

third logic means for calculating the amount of advance T in terms of a calculated number of pulses of a given pulse train derived from the cascade counter beginning immediately after a time interval Y which begins immediately after the pulse caused by the rotor passing the first device associated with the cylinder chamber into which the fuel is to be injected;

implementing logic responsive to the number of pulses after the rotor has passed said first device associated with the cylinder for implementing each newly computed beginning of, and time duration of, the fuel injection;

means for calculating the value of Y, where $Y=N$ milliseconds/720° $-T$, where N is the number of cylinders in the engine; and means for resetting said counter cascade to zero after calculating the values T and Y.

9. In a fuel injection type engine in accordance with claim 8, in which said third logic means comprises calculating means for calculating, after the resetting of said counter cascade, the value $T=McV^2$ milliseconds per degree, where $V^2$ is the square of the rotor count occurring every given time interval Z, milliseconds per degree is the milliseconds required for the engine crankshaft to rotate one degree of engine crankshaft rotation, and $M_c$ is a constant determined by various parameters and characteristics of the engine, and Y is the number of degrees of engine crankshaft rotation in milliseconds the engine crankshaft must rotate after passing the associated first device before the advance T of the fuel injection begins;

and in which the beginning of the advance T is determined by the expression Y=N milliseconds/720°−T, where N is the number of cylinders in the engine.

10. A fuel injection type internal combustion engine in accordance with claim 8 in which said first logic means comprises a second counter having a fixed capacity count;

means for calculating the value of Y where Y=N milliseconds/720°−T, where N is the number of cylinders in the engine;

a down counting register for receiving the value Y after the calculation thereof has been completed and for receiving a pulse train of a predetermined frequency which counts down the value Y in said down counting register until said count therein reaches a predetermined value;

said second counter responsive to said down counting register reaching its said predetermined value to permit throttle pulses to be counted in said second counter until said second counter reaches its fixed capacity after a time $T_x$ at which time no more throttle pulses are allowed to be counted; and fourth logic means responsive to the time period $T_x$ said second counter is receiving throttle pulses to provide an output signal during said time period $T_x$;

said fuel injection means being responsive to said output signal to inject fuel into the cylinder chamber being fired.

11. A fuel injection type internal combustion engine as in claim 10 in which said output signal is a high voltage and further in which said fuel injection device comprises;

means for injecting fuel directly into the associated cylinder chamber;

valve means having first and second conditions for enabling injection of fuel into said cylinder chamber when in said first condition and for preventing injection of fuel into said cylinder chamber when in said second condition;

means for containing a body of electro-rheological fluid around said valve means with said electro-rheological fluid responsive to a high voltage when applied thereacross, to freeze said valve in its said second condition to prevent the injection of fuel into said cylinder chamber and responsive to the absence of said high voltage to become fluid to enable the injection of fuel into said cylinder chamber, thereby determining the beginning of fuel injection and the time duration of said fuel injection; and terminals means for receiving the high voltage signal from said logic means and to impress said high voltage across the electro-rheological fluid to freeze at least a portion of the electro-rheological fluid to thereby prevent said valve from assuming its first condition.

12. A fuel injection internal combustion engine as in claim 8 in which said fuel injection device comprises;

a fuel ignition element positioned in the path of the fuel being injected to ignite said fuel when energized; and an electric power source connected to energize said fuel ignition element to ignite said fuel when it is injected into the cylinder chamber.

13. A fuel injection internal combustion engine as in claim 8 in which said fuel ignition element comprises:

a pair of electrodes positioned apart to form a gap therebetween in the path of the injected fuel; and means for supplying a high voltage source to said electrodes across said gap, when said first high voltage is not present to thereby cause an arc to exist across said gap when said fuel is first injected into said cylinder chamber.

14. A fuel injection internal combustion engine as in claim 8 in which each of said first devices is a Hall Effect transistor and the rotor is magnetized.

15. A method of electronically controlling the time of beginning of the fuel injection, the time duration of the fuel injection, and the burning of the fuel during its entire injection time in a fuel injection type internal combustion engine comprising an accelerator, N cylinder chambers, a piston associated with each cylinder chamber, and a distributor comprising N first devices and a rotatable rotor positioned to rotate past each of said first devices in sequential order and to generate a rotor pulse each rotation past one of said first devices, said method comprising the steps of:

a. providing N fuel injection devices each having a fuel ignition element extending into one of said N cylinder chambers to maintain burning of the injected fuel;

b. providing a counter cascade means for generating a series of frequency pulse trains each successively stepped down in frequency;

c. counting the number of first pulses derived from said counter cascade, of a predetermined frequency, and occurring during the time interval in which the engine crankshaft rotates M degrees, defined herein as milliseconds/M degrees;

d. determining the angular velocity of said engine crankshaft at any given time in terms of the number of said pulses per degree of engine crankshaft revolution (milliseconds per degree), where milliseconds per degree=milliseconds/M degrees/M;

e. generating a train of throttle pulses whose frequency varies with the degree of depression of said accelerator;

f. measuring the fuel injection time $T_x$ which is determined by the frequency of said train of throttle pulses generated by said accelerator;

g. counting and then comparing the number of rotor pulses and the number of throttle pulses occurring during a current given interval of time Z, where Z>milliseconds/M degrees≦Y in milliseconds per degree where Y is the time period marking the beginning of the advance before the piston reaches its top dead center, with predetermined changes in the number of rotor pulses and the number of throttle pulses counted during the immediately prior interval of time, to compute new beginning and time duration of fuel injection;

h. calculating the value Y=N milliseconds per 720°−T, where N is the number of engine cylinders and the 720° is measured in said first pulses;

i. calculating the amount of an advance $T=McV^2$ milliseconds per degree and in terms of the occurrence of a calculated number of said first pulses and with an advance beginning at a calculated time Y measured in terms of the number of said first pulses occurring after the occurrence of the pulse caused by the rotor passing the first device associated with the cylinder chamber into which the fuel is to be injected when the associated piston is at its bottom dead center, and with the calculated time Y marking the beginning of the advance before the piston reaches its top dead center, being determined by the expression $Y=N$ milliseconds/720° $-T$; and j. implementing each newly computed beginning and time duration of fuel injection by first counting Y of said first pulses after said rotor has passed the first device associated with the cylinder into which the fuel is being injected to determine the time period Y followed immediately thereafter by the injection of fuel towards the fuel ignition element at the end of the calculated time period Y for a time period $T_x$.

16. A method of controlling in accordance with claim 15 and further comprising the steps of:

providing a ring counter of a fixed count capacity, and in which:

step e generates a pulse train whose frequency varies inversely with the degree of accelerator depression; and step f measures the fuel injection time $T_x$ by responding to the end of time Y to enable the throttle pulses to count around said ring type counter;

and further comprising the step of injecting the fuel during the time period $T_x$.

17. A method of electronically controlling the time of beginning of the fuel injection, the time duration of the fuel injection, and the burning of the fuel during its entire injection time in a fuel injection type internal combustion engine comprising an engine crankshaft, an accelerator, a distributor having a rotatable rotor, and stationary N pulse producing devices each positioned at the perimeter of motion of the outer end of said rotor and each of a type which will produce a rotor pulse each time said rotor passes thereby, a piston and an associated cylinder chamber with the strokes of each piston bearing a predetermined positional relation with said rotor as the rotor passes the associated pulse producing device, N fuel injection devices each having an fuel ignition element extending into the associated cylinder chamber, and means for injecting fuel directly past each fuel ignition element at predeterminable time intervals with respect to the time said rotor passes a given pulse producing device and with said injected fuel being ignited by each fuel ignition element to burn during the entire fuel injection time to obtain a substantially non-stoichiometric mixture of fuel and air, said method comprising the steps of:

a. generating a series of pulse trains of different frequencies from a cascade counter;

b. computing the time, in milliseconds per M degrees, required for the engine crankshaft to rotate through M degrees, the instantaneous angular rotational velocity of the engine crankshaft per degree of rotation milliseconds per degree at any given time, and the number of rotor pulses occurring during a given time interval of time Z determined by a given number of selected first pulses generated by said cascade counter;

c. generating a train of throttle pulses whose frequency varies with the degree of depression of said accelerator;

d. computing the length of time of fuel injection, $T_x$, from the frequency of said train of throttle pulses;

e. counting the number of both rotor pulses and throttle pulses over said given time interval Z at periodic intervals;

f. determining the changes or lack of changes in the number of rotor and throttle pulses counted during each current time interval Z compared with the number of rotor and throttle pulses counted during the immediately prior time interval Z to determine whether an advance or a retarding of the beginning of fuel injection is required;

g. calculating the amount of advance, if required, measured from the time of occurrence of the pulse produced by the rotor passing the pulse producing device associated with the cylinder chamber in which the fuel is to be injected; and h. injecting the fuel from the computed time of beginning of fuel injection and burning the fuel during the entire computed duration $T_x$ of fuel injection.

18. A method of electronically controlling the time of beginning of the fuel injection, the time duration of the fuel injection, and the burning of the fuel during its entire fuel injection time in a fuel injection type internal combustion engine employing injector/ignitor devices and a throttle, N cylinder chambers, a piston associated with each cylinder chamber, and a distributor comprising N first devices and a rotatable rotor positioned to rotate past each of said first devices in sequential order and to generate a rotor pulse each rotation past one of said first devices, said method comprising the steps of:

a. counting the number of rotor pulses and the number of throttle pulses occurring during periodically occurring Z time intervals;

b. empirically determining whether an advance or a retard condition is required by comparing the changes in the rotor and throttle pulses in the most recent Z time interval with the rotor and throttle pulses in the immediately prior Z time interval;

c. calculating the advance T required in accordance with the expression $T=McV^2$ milliseconds/degree, where $V^2$ is the square of the rotor count every given time interval Z, milliseconds/degree are the milliseconds required for one degree of engine crankshaft revolution, Mc is the constant determined by various parameters and characteristics of the engine, and T is the amount of advance of fuel injection;

d. calculating the fuel injection time $T_x$ by the frequency of a signal whose frequency varies with the position of said throttle; and e. injecting the fuel for a time $T_x$ and beginning at the calculated advance or retard time.

19. In a fuel injection type internal combustion engine employing injector/ignitor devices and comprising a throttle, a distributor having a rotatable rotor, and N pulse producing devices each positioned at the perimeter of motion of the outer end of said rotor and each of a type which will produce a rotor pulse each time said rotor passes thereby, a piston and an associated cylinder chamber with the strokes of each piston bearing a predetermined positional relation with said rotor as the rotor passes the associated pulse producing device and N fuel ignition devices each extending into the cylinder chamber, and an fuel injector device for injecting fuel directly past each fuel/ignition element at predeterminable time intervals with respect to the time said rotor passes a given pulse producing device and with said injected fuel being ignited by each fuel injection element during the entire fuel injection time to obtain a substantially non-stoichiometric mixture of fuel and air, an electronic injection system for controlling the time of beginning and the time of duration of the injection of fuel into N each of said cylinder chambers and comprising:

first means for counting the number of rotor pulses and the number of throttle pulses occurring during periodically occurring Z time intervals;

decision making logic for empirically determining whether an advance or a retard condition is required by comparing the changes in rotor and throttle pulses in the most recent Z time interval with the immediately prior Z time interval;

first calculating means for calculating a required advance T in accordance with the expression: $T=McV^2$ milliseconds/degree, where $V^2$ is the square of the rotor count every given time interval Z, milliseconds per degree are the milliseconds required for one degree of engine crankshaft revolution, Mc is a constant determined by various parameters and characteristics of the engine, and T is the amount of advance of fuel injection;

second calculating means for calculating the fuel injection time $T_x$ by the frequency of a signal whose frequency varies with the position of said throttle; and second means comprising said injector/ignitor devices for injecting the fuel for a time $T_x$ and beginning at the calculated advance or retard time.

20. A method for electronically determining and controlling, in response to certain engine operating parameters, the beginning time of the fuel injection and the duration of the fuel injection, to improve the efficiency of a substantially non-stoichiometric fuel injected internal combustion engine having an engine crankshaft, N pulse producing devices each associated with one of N pistons and an engine crankshaft driven rotor which rotates sequentially past said pulse producing devices to generate pulses in said pulse producing devices as the rotor passes them and which determines the position of the piston as the associated pulse producing device produces a pulse, said method comprising the steps of:

a. periodically determining an updated time of initiation of fuel injection into each cylinder chamber by periodically comparing the relative changes in the engine crankshaft angular velocity and the position of the throttle over recurring predetermined time intervals and by the angular position of the engine crankshaft;

b. measuring the determined time of fuel injection from the time the rotor passes the pulse producing device associated with the piston in the cylinder chamber in which the fuel is to be injected;

c. determining the duration of the fuel injection into each cylinder chamber by sensing the position of the throttle continuously during each fuel injection period;

d. providing means for igniting the fuel at the beginning of the fuel injection; and e. injecting the fuel into each cylinder chamber directly at the fuel igniting means at the determined time of initiation of fuel injection to produce a substantially non-stoichiometric mixture until a new time of fuel injection is determined during the next recurring predetermined time interval.

21. In a fuel injection type internal combustion engine comprising a throttle, a distributor having a rotatable rotor, and N pulse producing devices, each positioned at the perimeter of motion of the outer end of said rotor and each of a type which will produce a rotor pulse each time said rotor passes thereby, a piston and an associated cylinder chamber with the strokes of each piston bearing a predetermined positional relation with said rotor as the rotor passes the associated pulse producing device, and N fuel ignition devices each extending into the cylinder chamber, and a fuel injection device for injecting fuel directly past each fuel ignition element at predeterminable time intervals with respect to the time said rotor passes a given pulse producing device to obtain a substantially non-stoichiometric mixture of fuel and air and with said injected fuel being ignited by each fuel ignition element during the entire fuel injection time, an electronic injection system for controlling the time of beginning and the time of duration of the injection of fuel into N each of said cylinder chambers and comprising:

first means for providing N injector/ignitor devices;

second means responsive to the position of said throttle to generate throttle pulses at a frequency dependent upon the position of said throttle;

third means for counting the number of rotor pulses and the number of throttle pulses occurring during periodically occurring Z time intervals;

decision making logic for empirically determining whether an advance or a retard condition is required by comparing the changes in rotor and throttle pulses in the most recent Z time interval with the immediately prior Z time interval;

first calculating means for calculating the advance T required in accordance with the expression $T=McV^2$ milliseconds/degree, where $V^2$ is the square of the rotor count every given time interval Z, milliseconds/degree are the milliseconds required for one degree of engine crankshaft revolution, Mc is a constant determined by various parameters and characteristics of the engine, and T is the amount of advance of fuel injection;

second calculating means for calculating the fuel injection time $T_x$ by the frequency of a signal whose frequency varies with the position of said throttle; and fourth means comprising said injector/ignitor devices for injecting the fuel for said fuel injection time time $T_x$ and beginning at the calculated advance T or retard time.

22. An electronically controlled fuel injector/ignitor device for use in an internal combustion engine having unrestricted airflow into the combustion chamber of the engine with a first portion of said injector/ignitor device being external of the combustion chamber and said engine and said combustion chamber and a second portion of said injector/ignitor device extending into said combustion chamber, and comprising:

first means for receiving fuel in said injector/ignitor device first portion;

electronically controlled valve means for temporarily retaining said fuel within said injector/ignitor device;

second means responsive to pressure from said combustion chamber for injecting the retained fuel into said combustion chamber through said second portion of said fuel injector when said valve is in its open condition and for terminating injection of said fuel into said combustion chamber when said valve means is in its closed position;

third means for igniting said fuel when said third means is energized;

fourth means for allowing unrestricted airflow into said combustion chamber; and electronic control means for controlling the opening of said valve to initiate the injection of said fuel into said combustion chamber.

23. In a fuel injection type internal combustion engine comprising an accelerator, a distributor having a rotatable rotor, and an N pulse producing device, each positioned at the perimeter of motion of the outer end of said rotor and each of which will produce a rotor pulse each time said rotor passes thereby, a piston and an associated cylinder chamber with the strokes of each piston bearing a predetermined positional relation with said rotor as the rotor passes the associated pulse position device, and N fuel ignition devices each extending into the cylinder chamber, and a fuel injection device for injecting fuel directly past each fuel ignition device at predeterminable time intervals with respect to the time said rotor passes a given pulse producing device to obtain a substantially non-stoichiometric mixture of fuel and air, and with said injected fuel being ignited by each fuel ignition element during the entire fuel injection time, an electronic injection system for controlling the time of beginning and the time of duration of the injection of fuel into N each of said cylinder chambers and comprising:

first means responsive to the position of said accelerator to generate pulses at a frequency dependent upon the position of said accelerator;

second means for counting the number of rotor pulses and the number of throttle pulses occurring during periodically occurring Z time intervals;

decision making logic for empirically determining whether an advance or a retard condition is required by comparing the changes in rotor and accelerator pulses in the most recent Z time interval with the immediately prior Z time interval;

first calculating means for calculating the advance T required in accordance with the expression $T=McV^2$, where $V^2$ is the square of the rotor count every given time interval Z, Mc is a constant determined by various parameters and characteristics of the engine, and T is the amount of advance of fuel injection;

second calculating means for calculating the fuel injection time $T_x$ by the frequency of a signal whose frequency varies with the position of said throttle; and third means for injecting the fuel for the time $T_x$ and beginning at the calculated advance or retard time.

* * * * *

UNITED STATES PATENT AND TRADEMARK OFFICE

CERTIFICATE OF CORRECTION

PATENT NO. : 4,911,123
DATED : March 27, 1990

INVENTOR(S) : George D. Elliott

It is certified that error appears in the above-identified patent and that said Letters Patent is hereby corrected as shown below:

Title page of patent at top, change name of inventor from "Ellicott" to --Elliott --.

Col. 12, line 1, change "$F=McV^2/V$" to --$F=McV^2/R$--.

Col 12, line 49, change "$V=4500(^4/2)3/60 =45.0$" to -- $V=4500(^4/2)\ .3/60 = 45.0$--.

Col. 12, line 53, change "3500" to --3000--.

Col. 12, line 58, change "Mostrand" to --Nostrand--.

Col 14, line 46, after "register", insert --262--.

Col. 15, line 52, change "t" to -- $t_w$--.

Col. 15, line 54, change "t" to --$t_y$--.

Col. 15, line 55, change "t" to --$t_x$--.

UNITED STATES PATENT AND TRADEMARK OFFICE

CERTIFICATE OF CORRECTION

PATENT NO. : 4,911,123

DATED : March 27, 1990

INVENTOR(S) : George D. Elliott

It is certified that error appears in the above-identified patent and that said Letters Patent is hereby corrected as shown below:

Col. 23, line 51, change "acelerator" to --accelerator--.

Signed and Sealed this

Seventeenth Day of March, 1992

*Attest:*

HARRY F. MANBECK, JR.

*Attesting Officer*

*Commissioner of Patents and Trademarks*